US011360427B2

(12) United States Patent
Shimizu et al.

(10) Patent No.: US 11,360,427 B2
(45) Date of Patent: Jun. 14, 2022

(54) CARTRIDGE AND REMANUFACTURING METHOD OF CARTRIDGE

(71) Applicant: CANON KABUSHIKI KAISHA, Tokyo (JP)

(72) Inventors: Hiroki Shimizu, Suntou-gun (JP); Tomofumi Kawamura, Suntou-gun (JP); Masakazu Tatsumi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/178,019

(22) Filed: Feb. 17, 2021

(65) Prior Publication Data

US 2021/0173339 A1 Jun. 10, 2021

Related U.S. Application Data

(63) Continuation of application No. 16/805,504, filed on Feb. 28, 2020, now Pat. No. 10,955,794.

(30) Foreign Application Priority Data

Mar. 8, 2019 (JP) ..... JP2019-042259
Jan. 17, 2020 (JP) ..... JP2020-005915

(51) Int. Cl.
*G03G 21/18* (2006.01)
*G03G 15/08* (2006.01)

(52) U.S. Cl.
CPC ..... *G03G 21/1839* (2013.01); *G03G 15/087* (2013.01)

(58) Field of Classification Search
CPC ..... G03G 21/1839; G03G 15/087
See application file for complete search history.

(56) References Cited

U.S. PATENT DOCUMENTS 6,968,141 B2 * 11/2005 Fujita ..... G03G 15/0894 399/109
8,238,784 B2 * 8/2012 Kusudo ..... G03G 21/1821 399/109

* cited by examiner

*Primary Examiner* — Victor Verbitsky
(74) *Attorney, Agent, or Firm* — Canon U.S.A., Inc. IP Division

(57) ABSTRACT

In a remanufacturing method for remanufacturing a cartridge from a material cartridge, the material cartridge is attachable to and detachable from an apparatus main body of an image forming apparatus, and the apparatus main body includes a guide member. The material cartridge includes a frame member including an engagement portion configured to be engaged with the guide member, and a first attachment portion provided in the engagement portion, and a first storage member. The first storage member includes a first holding portion configured to hold a first electrode and be attached to the first attachment portion. The remanufacturing method includes detaching the first holding portion, attaching a second electrode to the frame member, and attaching a second storage element to the frame member at a different position from a position of the first attachment portion.

9 Claims, 15 Drawing Sheets

CARTRIDGE AND REMANUFACTURING METHOD OF CARTRIDGE

CROSS REFERENCE TO RELATED APPLICATIONS

This application is a continuation of U.S. patent application Ser. No. 16/805,504, filed on Feb. 28, 2020, which claims priority from Japanese Patent Applications No. 2019-042259, filed Mar. 8, 2019, and No. 2020-005915, filed Jan. 17, 2020, all of which are hereby incorporated by reference herein in their entirety.

BACKGROUND

Field of the Disclosure

The present disclosure relates to a cartridge for use in an electrophotographic image forming apparatus such as a copying machine or a printer, and a remanufacturing method for remanufacturing a cartridge.

Description of the Related Art

An electrophotographic image forming apparatus (hereinafter, "image forming apparatus") is an apparatus that forms an image on a recording medium using an electrophotographic image forming method. Examples of the image forming apparatus include an electrophotographic copying machine, an electrophotographic printer (e.g., a light-emitting diode (LED) printer and a laser beam printer), a facsimile apparatus, and a word processor.

A developing device includes a developing unit that operates on an electrophotographic photosensitive member (hereinafter, "photosensitive member"). The developing device is occasionally configured as a cartridge attachable to and detachable from an apparatus main body of the image forming apparatus.

A cartridge is configured to be attachable to and detachable from the apparatus main body of the image forming apparatus. Examples of the cartridge include a process cartridge. The process cartridge is a cartridge including a photosensitive member and process units that operate on the photosensitive member. Examples of the process units include a developing unit, a charging unit, and a cleaning unit. Other examples of the cartridge include a cartridge including a developing unit (e.g., a developing cartridge). In a method using such a cartridge, maintenance of the image forming apparatus can be performed by replacing the cartridge.

A cartridge as described above may mount a storage member such as a memory chip having a storage element that stores service information or process information. An image forming apparatus utilizes the information stored in the storage element, thereby further improves image quality and the maintainability of the cartridge.

If a cartridge loses its commercial value, a component of the cartridge may be replaced, and the cartridge may become a commercial product again. Japanese Patent Application Laid-Open No. 2004-47397 discusses a remanufacturing method for detaching a storage member attached to a frame member of a cartridge and attaching a new storage member.

Japanese Patent Application Laid-Open No. 2017-142490 discusses a storage member having a storage element and an electrode. A slit portion to which the storage member is attached is placed in a portion to be guided by a guide member of an apparatus main body of an image forming apparatus when a cartridge is attached.

In a case where a cartridge includes a storage member placed in a portion to be engaged with a guide member of an apparatus main body, the shape and the size of the storage member need to satisfy requirements to prevent collision with the guide member.

SUMMARY

The present disclosure is directed to easing shape and size requirements for a new storage member (e.g., a member having a new storage element and a new electrode), in a case where a cartridge is remanufactured by replacing a storage member placed in a portion to be engaged with a guide member.

According to an aspect of the present disclosure, to solve the above issue, the disclosure regarding the present application is as follows.

A remanufacturing method for remanufacturing a cartridge from a material cartridge, the material cartridge being attachable to and detachable from an apparatus main body of an image forming apparatus, the apparatus main body including a main body electrode and a guide member configured to guide the material cartridge when the material cartridge is attached or detached, the material cartridge including a frame member including an engagement portion configured to be engaged with the guide member, and a first attachment portion provided in the engagement portion, and a first storage member including a first storage element configured to store information, a first electrode electrically connected to the first storage element, and a first holding portion configured to hold the first storage element and the first electrode, the first holding portion attached to the first attachment portion, the first electrode configured to come into contact with the main body electrode, includes detaching the first holding portion from the first attachment portion, attaching a second electrode to the frame member, and attaching a second storage element configured to store information to the frame member by attaching the second storage element to a second attachment portion located at a different position from a position of the first attachment portion, wherein the second storage element and the second electrode are electrically connected together by a connection member, and wherein the second electrode is configured to come into contact with the main body electrode and placed in the engagement portion.

According to an aspect of the present disclosure, to solve the above issue, the disclosure regarding the present application is as follows.

A cartridge attachable to and detachable from an apparatus main body of an image forming apparatus, the apparatus main body including a main body electrode and a guide member configured to guide the cartridge when the cartridge is attached or detached, includes a frame member including an engagement portion configured to be engaged with the guide member, a cartridge electrode configured to come into contact with the main body electrode, an electrode holding portion configured to hold the cartridge electrode and be attached to the frame member, a storage element configured to store information, an element holding portion configured to hold the storage element and be attached to the frame member, and a connection member configured to electrically connect the cartridge electrode and the storage element, wherein the cartridge electrode and the electrode holding portion are placed in the engagement portion, and the element holding portion is attached to the frame member at a position away from the electrode holding portion.

Further features of the present disclosure will become apparent from the following description of exemplary embodiments with reference to the attached drawings.

DESCRIPTION OF THE EMBODIMENTS (Overall Configuration of Image Forming Apparatus)

Figure 2:
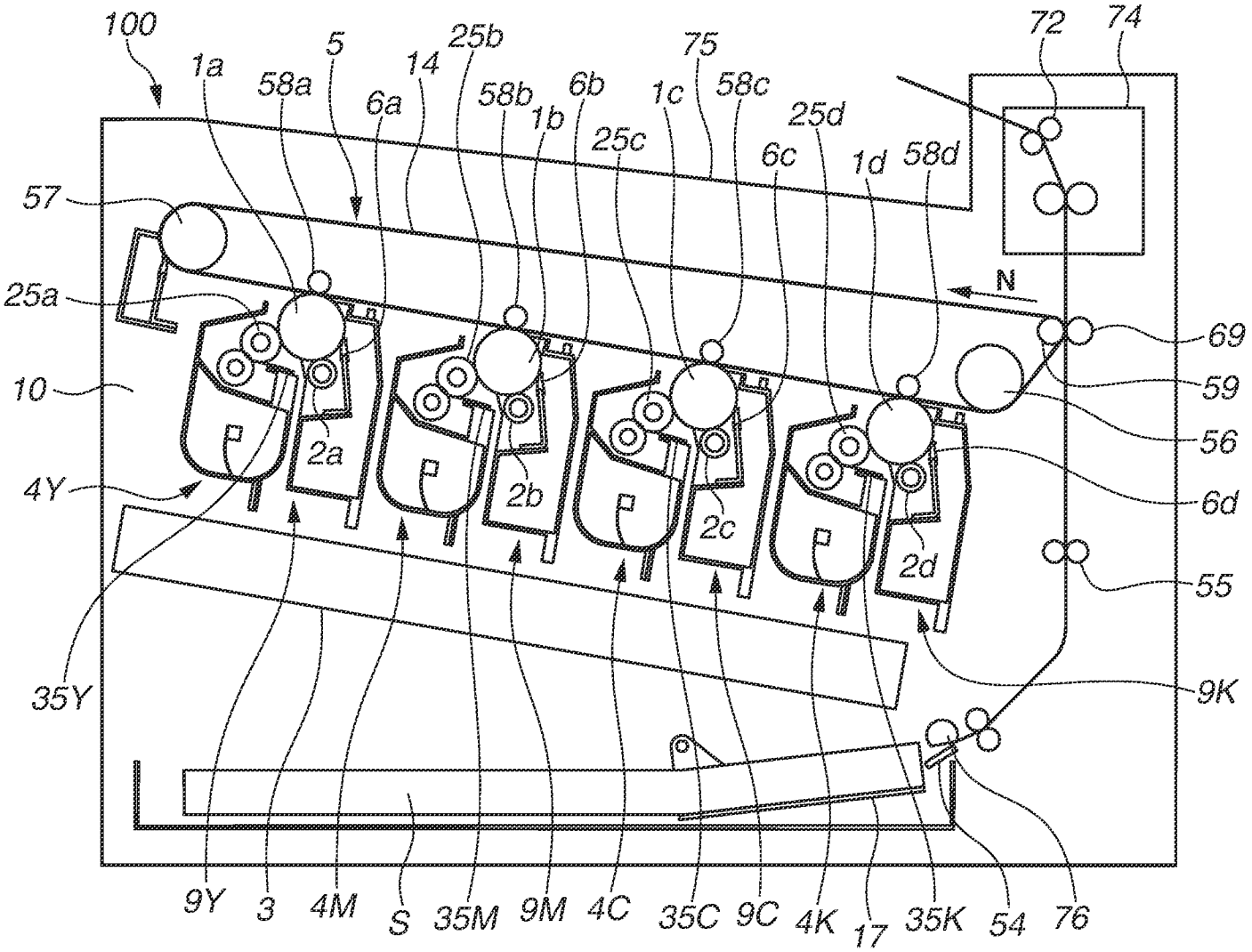
FIG. 2 is a schematic cross-sectional view of an electrophotographic image forming apparatus, according to one or more aspects of the subject disclosure.

First, the overall configuration of an electrophotographic image forming apparatus (hereinafter, "image forming apparatus") 100 is described with reference to FIG. 2. FIG. 2 is a schematic cross-sectional view of the image forming apparatus 100 according to the present exemplary embodiment.

As illustrated in FIG. 2, drum cartridges (cartridges) 9 as photosensitive units and developing cartridges 4 as developing devices are attached to an apparatus main body 10 of the image forming apparatus 100. In the present exemplary embodiment, four drum cartridges 9 (9Y, 9M, 9C, 9K) and four developing cartridges 4 (4Y, 4M, 4C, 4K) are attached to the apparatus main body 10. The drum cartridges 9 and the developing cartridges 4 are configured to be attachable to and detachable from the apparatus main body 10.

As illustrated in FIG. 2, the drum cartridges 9 and the developing cartridges 4 are arranged inclined with respect to the horizontal direction in a state where the drum cartridges 9 and the developing cartridges 4 are attached to the apparatus main body 10.

Each drum cartridge 9 (9Y, 9M, 9C, 9K) includes an electrophotographic photosensitive member (hereinafter, "photosensitive drum") 1 (1*a*, 1*b*, 1*c*, 1*d*) as an image bearing member that bears an electrostatic latent image. Near the photosensitive drum 1, process units such as a charging roller 2 (2*a*, 2*b*, 2*c*, 2*d*) as a charging member and a cleaning member 6 (6*a*, 6*b*, 6*c*, 6*d*) as a cleaning member are included. The charging roller 2 (2*a*, 2*b*, 2*c*, 2*d*) charges the surface of the photosensitive drum 1 (1*a*, 1*b*, 1*c*, 1*d*). As will be described below, an electrostatic latent image formed on the photosensitive drum 1 (1*a*, 1*b*, 1*c*, 1*d*) is developed with toner as a developer, thereby forming a toner image on the photosensitive drum 1 (1*a*, 1*b*, 1*c*, 1*d*). After the toner image formed on the photosensitive drum 1 (1*a*, 1*b*, 1*c*, 1*d*) is transferred onto a recording medium S, the cleaning member 6 (6*a*, 6*b*, 6*c*, 6*d*) removes toner remaining on the photosensitive drum 1 (1*a*, 1*b*, 1*c*, 1*d*).

Each developing cartridge 4 (4Y, 4M, 4C, 4K) includes a developing roller 25 (25*a*, 25*b*, 25*c*, 25*d*) as a developer bearing member that bears toner. The developing cartridge 4 (4Y, 4M, 4C, 4K) includes a developing blade 35 (35Y, 35M, 35C, 35K) as a regulation member. An electrostatic latent image formed on the photosensitive drum 1 (1*a*, 1*b*, 1*c*, 1*d*) is developed by the developing roller 25 (25*a*, 25*b*, 25*c*, 25*d*). This forms toner images of respective colors on the photosensitive drums 1 (1*a*, 1*b*, 1*c*, 1*d*).

In the present exemplary embodiment, each drum cartridge 9 (9Y, 9M, 9C, 9K) is configured to be attachable to and detachable from the apparatus main body 10 along the axis direction of the photosensitive drum 1 (1*a*, 1*b*, 1*c*, 1*d*). Each developing cartridge 4 (4Y, 4M, 4C, 4K) is configured to be attachable to and detachable from the apparatus main body 10 along the axis direction of the developing roller 25 (25*a*, 25*b*, 25*c*, 25*d*). In the attachment directions of the drum cartridge 9 and the developing cartridge 4, the upstream side is defined as a front surface side, and the downstream side is defined as a rear surface side.

The apparatus main body 10 includes a scanner unit 3 as an exposure device. The scanner unit 3 is placed below the drum cartridges 9 and the developing cartridges 4. Each photosensitive drum 1 (1*a*, 1*b*, 1*c*, 1*d*) charged by the charging roller 2 (2*a*, 2*b*, 2*c*, 2*d*) is exposed by the scanner unit 3. Thereby, electrostatic latent images corresponding to image information on the photosensitive drums 1 (1*a*, 1*b*, 1*c*, 1*d*) are formed.

A cassette 17 that stores recording media S such as paper is attached to the apparatus main body 10. The cassette 17 is placed below the scanner unit 3.

The apparatus main body 10 includes a feeding roller 54, a conveying roller pair 76, and a registration roller pair 55. The feeding roller 54 separates the recording media S in the cassette 17 one by one, and feeds each recording medium S. The conveying roller pair 76 conveys the fed recording medium S. The registration roller pair 55 synchronizes electrostatic latent images formed on the photosensitive drums 1 with the recording medium S.

An intermediate transfer unit 5 as an intermediate transfer unit is attached to the apparatus main body 10. The intermediate transfer unit 5 is placed above the drum cartridges 9 and the developing cartridges 4. A toner image formed on the photosensitive drum 1 (1*a*, 1*b*, 1*c*, 1*d*) is transferred onto the intermediate transfer unit 5. The intermediate transfer unit 5 includes a driving roller 56, a driven roller 57, primary transfer rollers 58 (58*a*, 58*b*, 58*c*, and 58*d*), and an opposing roller 59. The intermediate transfer unit 5 further includes a transfer belt 14.

The primary transfer rollers 58 (58*a*, 58*b*, 58*c*, and 58*d*) are placed at positions corresponding to the respective photosensitive drums 1 (1*a*, 1*b*, 1*c*, and 1*d*). The opposing roller 59 is placed at a position opposed to a secondary transfer roller 69. During an image forming operation, the transfer belt 14 circularly moves in the direction of an arrow N illustrated in FIG. 2 in a state where the transfer belt 14 is opposed to and in contact with the photosensitive drums 1 (1*a*, 1*b*, 1*c*, and 1*d*).

Voltages are applied to the primary transfer rollers 58 (58*a*, 58*b*, 58*c*, and 58*d*), thereby transferring toner images from the photosensitive drums 1 (1*a*, 1*b*, 1*c*, and 1*d*) onto the transfer belt 14. Voltages are applied to the opposing roller 59 and the secondary transfer roller 69, thereby transferring the toner images from the transfer belt 14 onto a recording medium S.

The apparatus main body 10 includes a fixing unit 74. A recording medium S on which a toner image is formed is conveyed upward, and is heated and pressurized by the fixing unit 74. Then, the toner image is fixed to the recording medium S. Then, the recording medium S is discharged to a discharge unit 75 by discharge rollers 72.

(Drum Cartridge)

Figure 3:
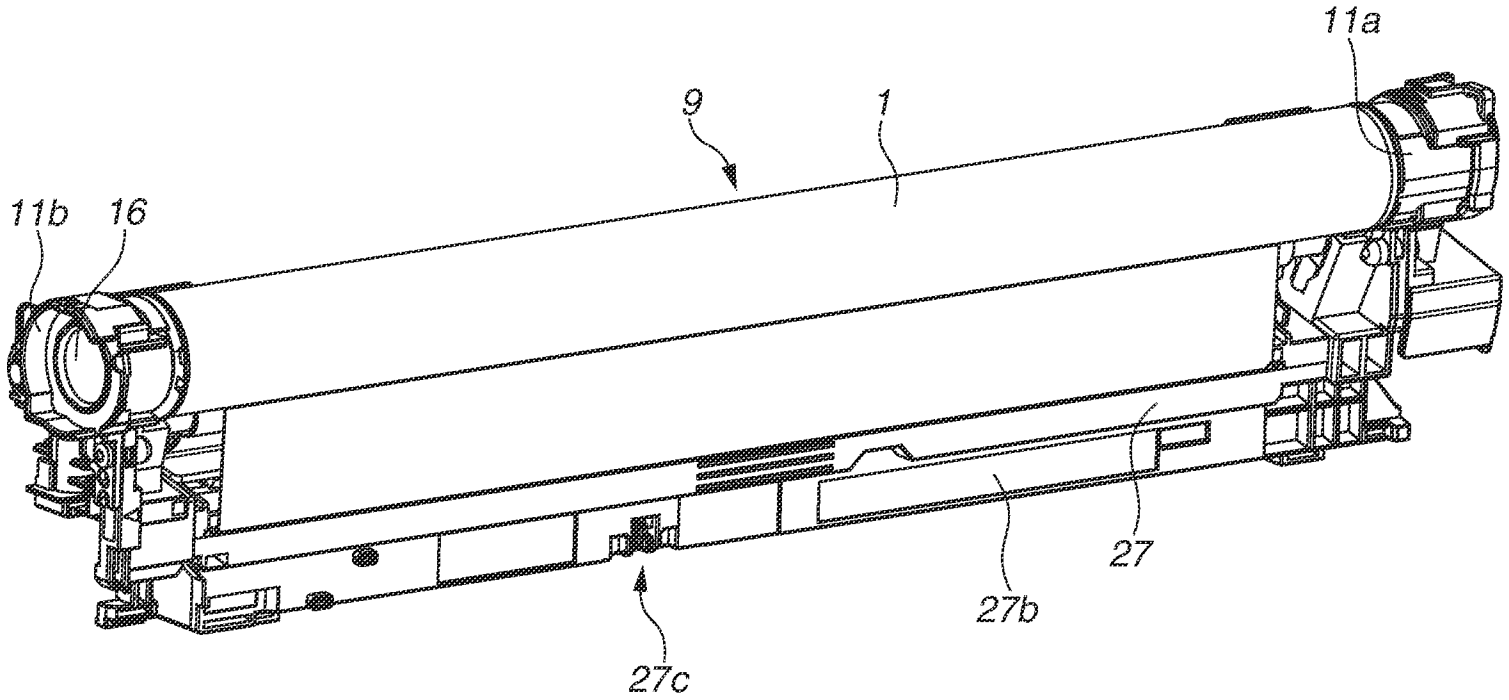
FIG. 3 is a schematic perspective view of a drum cartridge, according to one or more aspects of the subject disclosure.
Figure 4:
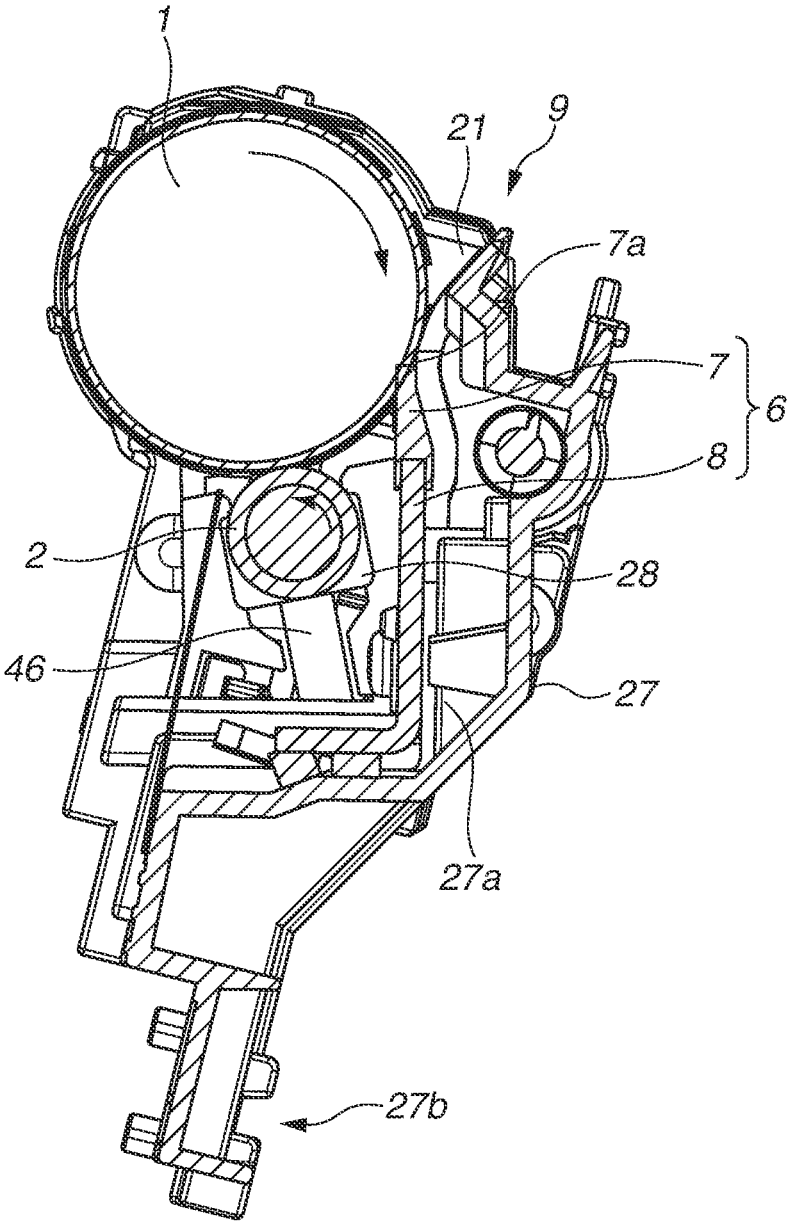
FIG. 4 is a cross-sectional view of the drum cartridge, according to one or more aspects of the subject disclosure.

Each drum cartridge 9 (9Y, 9M, 9C, 9K) is described with reference to FIGS. 3 and 4. FIG. 3 is a schematic perspective view of the drum cartridge 9 according to the present exemplary embodiment. FIG. 4 is a cross-sectional view of the drum cartridge 9 according to the present exemplary embodiment. More specifically, FIG. 4 is a cross-sectional view in a direction orthogonal to the rotational axis direction of the photosensitive drum 1. In other words, FIG. 4 is a diagram illustrating the drum cartridge 9 cut in the direction orthogonal to the rotational axis direction of the photosensitive drum 1 and viewed along the rotational axis direction of the photosensitive drum 1. In the present exemplary embodiment, the drum cartridges 9Y, 9M, 9C, and 9K have the same configuration. Thus, in the following description, one of the drum cartridges 9 is described. In the present exemplary embodiment, in the insertion directions of the drum cartridge 9 and the developing cartridge 4, the upstream side is defined as a near side, and the downstream side is defined as a far side.

As illustrated in FIG. 3, the drum cartridge 9 includes a drum frame member 27. The photosensitive drum 1 is rotatably supported by the drum frame member 27 through a first drum bearing 11*b* and a second drum bearing 11*a*. The photosensitive drum 1 can rotate about a rotational axis indicated by a dashed line.

The drum cartridge 9 includes a drum coupling 16 as a drive reception member that receives drive from the apparatus main body 10. The first drum bearing 11*b* and the drum coupling 16 are placed on one end side of the drum frame member 27 in the rotational axis direction of the photosensitive drum 1 (e.g., the longitudinal direction of the drum cartridge 9). The second drum bearing 11*a* is placed on the other end side of the drum frame member 27. The drum frame member 27 includes a guided portion 27*b* and a first attachment portion 27*c*.

As illustrated in FIG. 4, the charging roller 2 and the cleaning member 6 are placed near the photosensitive drum 1. The cleaning member 6 includes an elastic member 7 formed of a rubber blade and a cleaning supporting member 8. In the image forming operation, the photosensitive drum 1 rotates in the direction of an arrow illustrated in FIG. 4. The elastic member 7 abuts the photosensitive drum 1 in a direction counter to the rotational direction of the photosensitive drum 1. Residual toner removed from the photosensitive drum 1 by the cleaning member 6 falls into a residual toner chamber 27*a* of the drum frame member 27.

As illustrated in FIG. 4, a sealing sheet 21 is attached to the drum frame member 27 and abuts the photosensitive drum 1. The sealing sheet 21 prevents residual toner in the residual toner chamber 27*a* from leaking through the gap between the drum frame member 27 and the photosensitive drum 1.

The driving force of a main body driving motor (not illustrated) as a driving source is transmitted to the drum coupling 16 of the drum cartridge 9, whereby the photosensitive drum 1 rotates according to the image forming operation. As illustrated in FIG. 4, the charging roller 2 is rotatably supported by the drum frame member 27 through a charging roller bearing 28. The charging roller 2 is pressed toward the photosensitive drum 1 by a pressing member 46 and rotated by the photosensitive drum 1 in the direction of an arrow illustrated in FIG. 4.

(Developing Cartridge)

Figure 5:
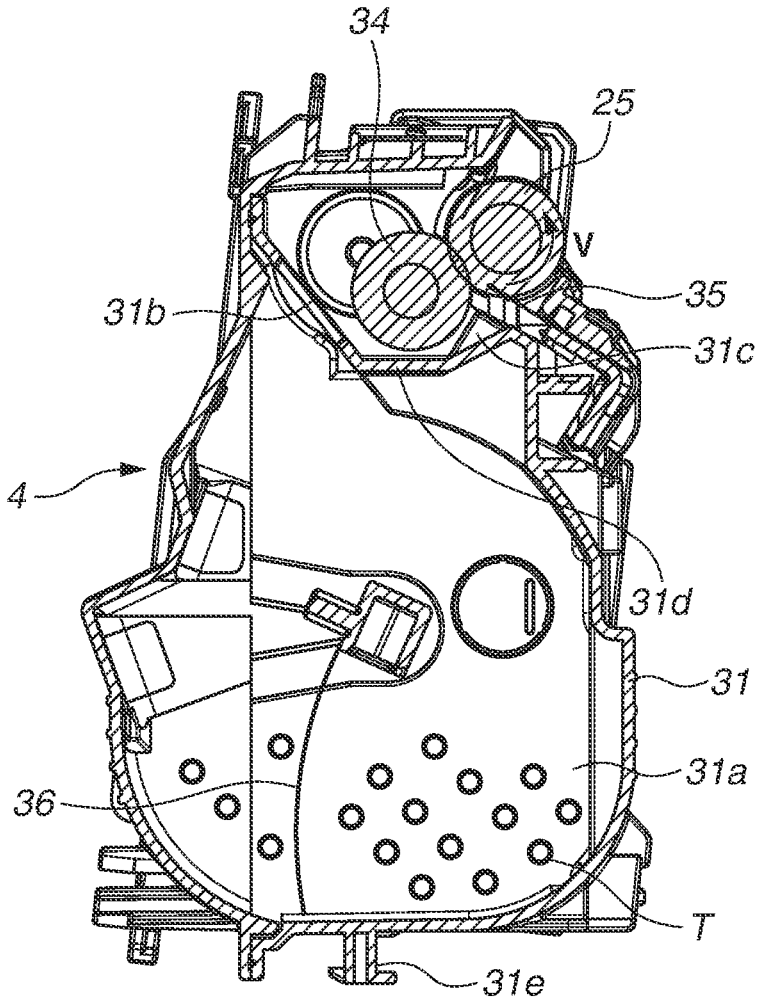
FIG. 5 is a cross-sectional view of a developing cartridge, according to one or more aspects of the subject disclosure.

Next, each developing cartridge 4 (4Y, 4M, 4C, 4K) is described with reference to FIG. 5. FIG. 5 is a cross-sectional view of the developing cartridge 4 according to the present exemplary embodiment. More specifically, FIG. 5 is a cross-sectional view in a direction orthogonal to the rotational axis direction of the developing roller 25.

The developing cartridge 4Y that stores yellow toner, the developing cartridge 4M that stores magenta toner, the developing cartridge 4C that stores cyan toner, and the developing cartridge 4K that stores black toner have the same configuration. Thus, one of the developing cartridges 4 is described in the following description. In the following description, toner is not distinguished by colors, and is simply referred to as "toner T".

The developing cartridge 4 includes a developing frame member 31 as a frame member, the developing roller 25, a toner supply roller 34 that rotates in contact with the developing roller 25, the developing blade 35 that regulates a toner layer on the developing roller 25, and a toner conveying member 36. The developing frame member 31 stores toner T. The developing roller 25, the toner supply roller 34, the developing blade 35, and the toner conveying member 36 are rotatably supported by the developing frame member 31. The developing blade 35 is fixed to the developing frame member 31. In the image forming operation, the developing roller 25 rotates in the direction of an arrow V illustrated in FIG. 5. The toner supply roller 34 rotates in the state where the toner supply roller 34 is in contact with the developing roller 25. In the state where the developing roller 25 is in contact with the photosensitive drum 1, the developing roller 25 rotates in the direction of the arrow V, thereby developing an electrostatic latent image formed on the surface of the photosensitive drum 1 with the toner T.

The developing frame member 31 includes a developing chamber 31*c* and a toner storage chamber 31*a* located below the developing chamber 31*c*. The developing roller 25 and the toner supply roller 34 are placed in the developing chamber 31*c*. The developing chamber 31*c* and the toner storage chamber 31*a* are separated by a partition wall 31*d*. In the partition wall 31*d*, a toner opening 31*b* is provided so that the toner T passes through the toner opening 31*b* when the toner T is conveyed from the toner storage chamber 31*a* to the developing chamber 31*c*.

The developing frame member 31 further includes a biased portion 31*e*. The biased portion 31*e* is biased by a biasing member (not illustrated) provided in the apparatus main body 10. This enables the developing frame member 31 to move between the position where the developing roller 25 abuts the photosensitive drum 1 and a position where the developing roller 25 is away from the photosensitive drum 1.

The developing frame member 31 includes development bearings (not illustrated) that support the developing roller 25. The development bearings are placed at the respective ends of the developing frame member 31 in the rotational axis direction of the developing roller 25.

As illustrated in FIG. 5, the developing blade 35 abuts the developing roller 25 and regulates the toner T borne on the developing roller 25. Thereby, a toner layer having a uniform thickness on the surface of the developing roller 25 is formed.

In the toner storage chamber 31*a* of the developing frame member 31, the toner conveying member 36 is provided that agitates the stored toner T and also conveys the toner T to the developing chamber 31*c* through the toner opening 31*b*.

(Attachment of Drum Cartridge and Developing Cartridge)

Figure 6:
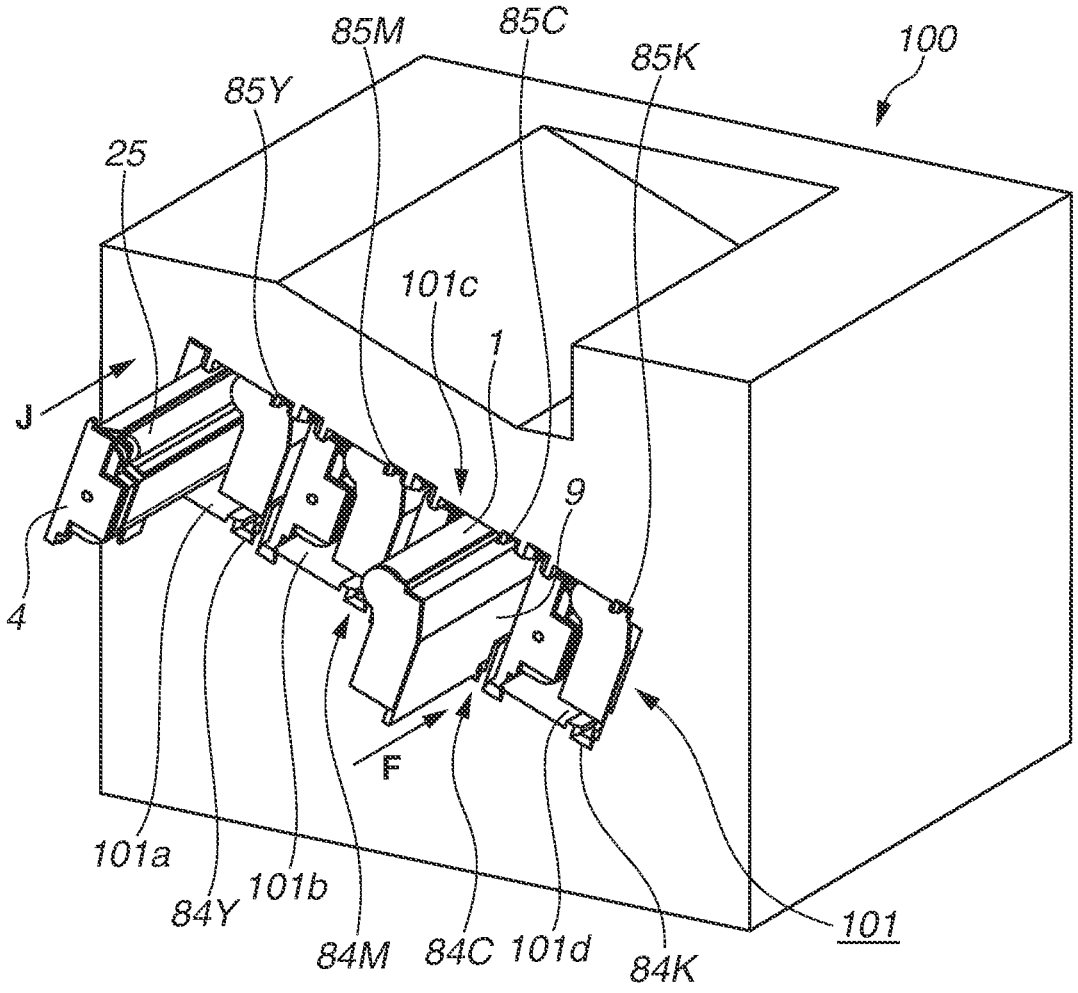
FIG. 6 is a diagram illustrating attachment of the drum cartridge and the developing cartridge, according to one or more aspects of the subject disclosure.

Next, a description is given of a configuration in which the drum cartridge 9 and the developing cartridge 4 are inserted into the apparatus main body 10 of the image forming apparatus 100 with reference to FIG. 6. FIG. 6 is a diagram illustrating the attachment of the drum cartridge 9 and the developing cartridge 4 according to the present exemplary embodiment.

Each drum cartridge 9 (9Y, 9M, 9C, 9K) and each developing cartridge 4 (4Y, 4M, 4C, 4K) are inserted into an opening portion 101 (101*a*, 101*b*, 101*c*, 101*d*) of the apparatus main body 10.

The drum cartridge 9 is attached and detached along the rotational axis direction of the photosensitive drum 1 (e.g., the direction of an arrow F illustrated in FIG. 6). The developing cartridge 4 is attached and detached along the rotational axis direction of the developing roller 25 (e.g., the direction of an arrow J illustrated in FIG. 6). In other words, the attachment direction of the drum cartridge 9 is the rotational axis direction of the photosensitive drum 1. The attachment direction of the developing cartridge 4 is the rotational axis direction of the developing roller 25. When the drum cartridge 9 and the developing cartridge 4 are detached, the drum cartridge 9 and the developing cartridge 4 are moved in directions opposite to the attachment directions. In the present exemplary embodiment, the attachment/detachment direction of the developing cartridge 4 and the attachment/detachment direction of the drum cartridge 9 are parallel to each other.

In the present exemplary embodiment, the developing cartridge 4 and the drum cartridge 9 can be attached to and detached from the apparatus main body 10 independently of each other. In a state where the developing cartridge 4 and the drum cartridge 9 are attached to the apparatus main body 10, the rotational axis direction of the developing roller 25 and the rotational axis direction of the photosensitive drum 1 are parallel to each other.

The apparatus main body 10 includes a member configured to guide the developing cartridge 4 when the developing cartridge 4 is attached or detached. The apparatus main body 10 also includes a guide member 84 (84Y, 84M, 84C, 84K) as a member configured to guide the drum cartridge 9 when the drum cartridge 9 is attached or detached. The apparatus main body 10 further includes an upper guide member 85 (85Y, 85M, 85C, 85K) that guides the drum cartridge 9 together with the guide member 84 (84Y, 84M, 84C, 84K).

Each guide member 84 (84Y, 84M, 84C, 84K) is configured to guide the drum frame member 27. The guide members 84 (84Y, 84M, 84C, and 84K) are provided in a lower portion of the apparatus main body 10. The guide members 84 (84Y, 84M, 84C, and 84K) have the same configuration. Thus, in the following description, one of the guide members 84 is described.

(Relationship Between Drum Cartridge and Guide Member)

A relationship between the drum cartridge 9 and the guide member 84 is described in further detail with reference to FIGS. 7A, 7B, 8A, and 8B.

Figure 7A:
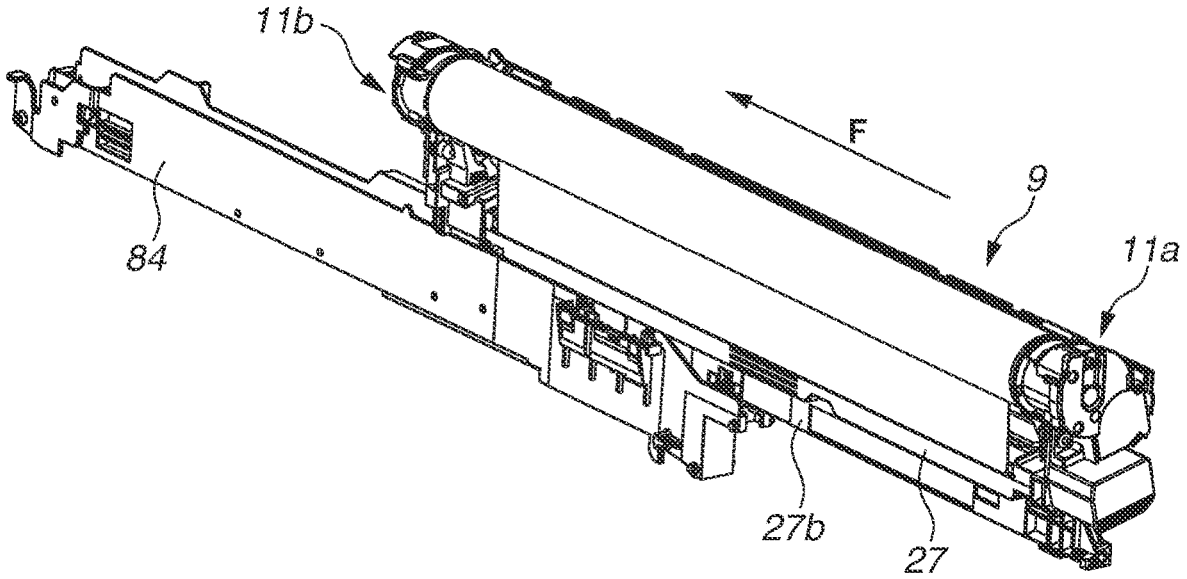
FIGS. 7A and 7B are diagrams illustrating the attachment of the drum cartridge, according to one or more aspects of the subject disclosure.
Figure 7B:
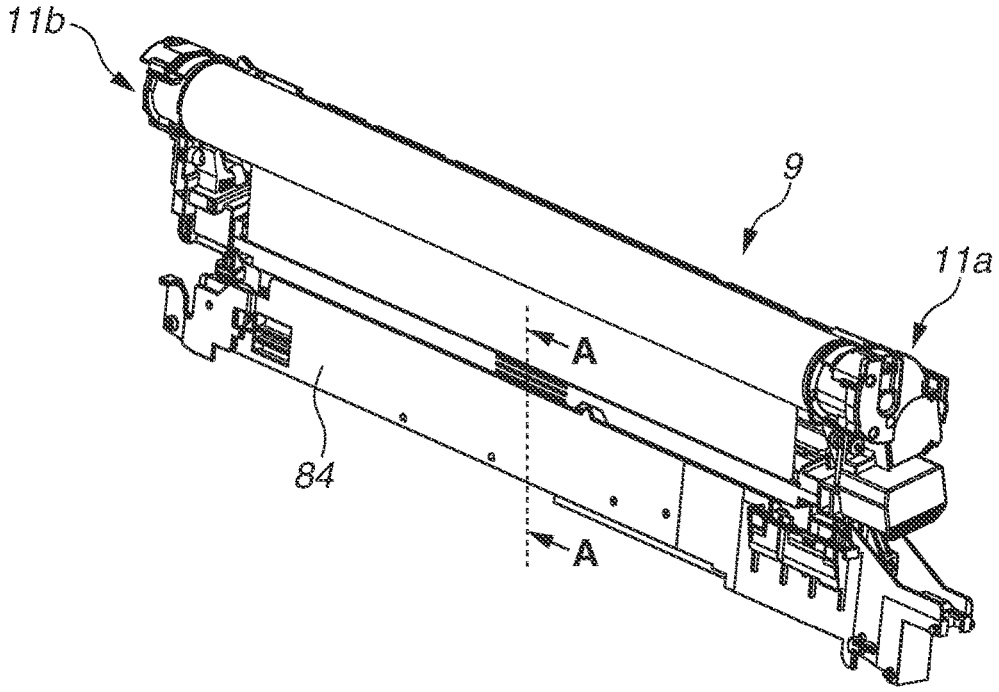
Figure 8A:
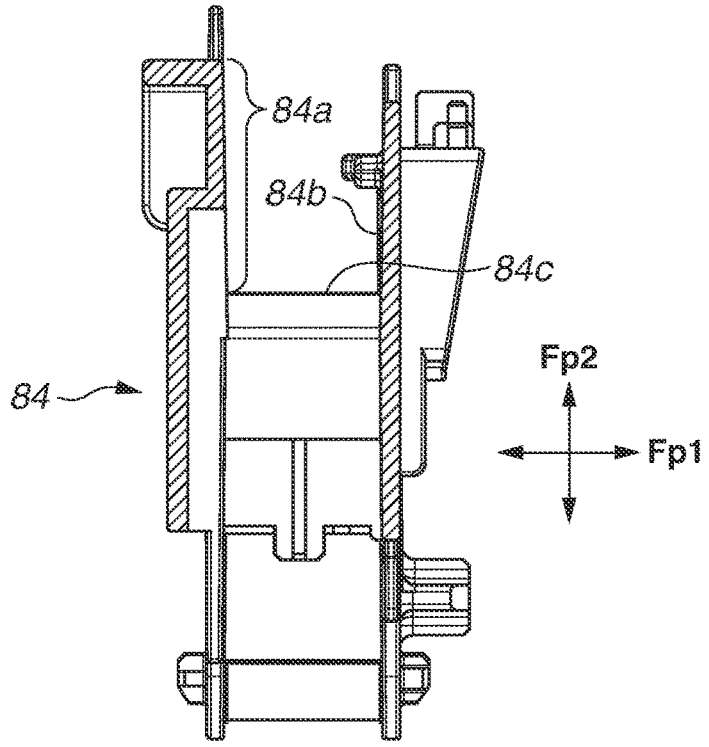
FIGS. 8A and 8B are cross-sectional views illustrating a configuration of a guide member, according to one or more aspects of the subject disclosure.
Figure 8B:
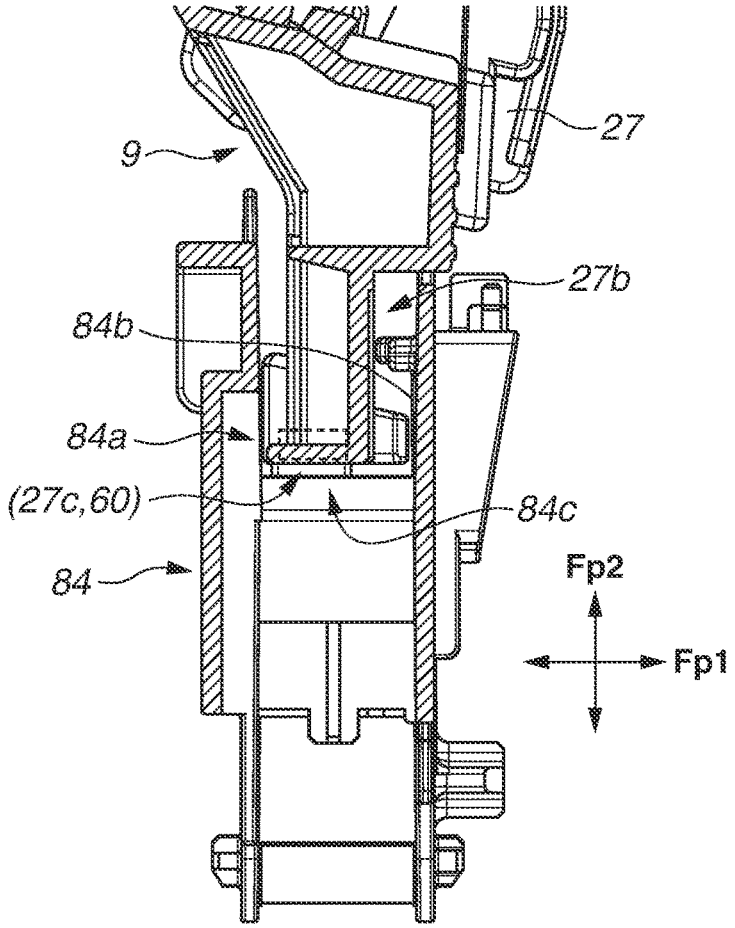

FIGS. 7A and 7B are diagrams illustrating the attachment of the drum cartridge 9 according to the present exemplary embodiment. FIG. 7A is a diagram illustrating the intermediate state of the attachment of the drum cartridge 9. FIG. 7B is a diagram illustrating the state where the attachment of the drum cartridge 9 is completed. FIGS. 8A and 8B are cross-sectional views illustrating the configuration of the guide member 84 according to the present exemplary embodiment. FIG. 8A is a cross-sectional view of the guide member 84. FIG. 8B is a cross-sectional view of the guide member 84 and the drum cartridge 9. FIGS. 8A and 8B are cross-sectional views in the direction orthogonal to the rotational axis direction of the photosensitive drum 1. That is, FIGS. 8A and 8B are diagrams illustrating the guide member 84 cut in the direction orthogonal to the rotational axis direction of the photosensitive drum 1 and viewed along the rotational axis direction of the photosensitive drum 1. In other words, a direction perpendicular to the plane of the paper in FIGS. 8A and 8B is the attachment/detachment direction of the drum cartridge 9.

As illustrated in FIG. 7A, the drum cartridge 9 is attached in the direction of an arrow F along the rotational axis direction of the photosensitive drum 1. At this time, the second drum bearing 11*a* is located upstream of the first drum bearing 11*b* in the attachment direction of the drum cartridge 9. The drum frame member 27 also includes the guided portion 27*b*. The guided portion 27*b* is guided by the guide member 84 when the drum cartridge 9 is attached to the apparatus main body 10. In a state of FIG. 7A, a part of the drum cartridge 9 is exposed to outside the apparatus main body 10.

As illustrated in FIG. 7B, in a state where the drum cartridge 9 is attached to the apparatus main body 10, the guided portion 27*b* is engaged with the guide member 84. In a state of FIG. 7B, an entirety of the drum cartridge 9 is accommodated within the apparatus main body 10. In other words, the drum cartridge 9 is guided by the guide member 84, thereby moving from the position where at least a part of the drum cartridge 9 is exposed to outside the apparatus main body 10 to the position where the entirety of the drum cartridge 9 is accommodated within the apparatus main body 10.

As illustrated in FIG. 8A, the guide member 84 includes a first guide surface 84*a* and a second guide surface 84*b* opposed to the first guide surface 84*a*. The guide member 84 includes a third guide surface 84*c*.

A direction intersecting (e.g., in the present exemplary embodiment, a direction orthogonal to) the attachment direction of the drum cartridge 9 is referred to as a "first intersection direction Fp1". As illustrated in FIG. 8B, the first guide surface 84*a* and the second guide surface 84*b* restrict the movement of the drum cartridge 9 in the first intersection direction Fp1. More specifically, the first guide surface 84*a* abuts the guided portion 27*b* when the drum cartridge 9 moves in a first direction along the first intersection direction Fp1, thereby restricting the movement of the drum cartridge 9. The second guide surface 84*b* abuts the guided portion 27*b* when the drum cartridge 9 moves in a direction (a second direction) opposite to the first direction along the first intersection direction Fp1, thereby restricting the movement of the drum cartridge 9.

A direction intersecting (e.g., in the present exemplary embodiment, a direction orthogonal to) the direction intersecting the attachment direction of the drum cartridge 9 and the first intersection direction Fp1 is referred to as a "second intersection direction Fp2". As illustrated in FIG. 8B, the third guide surface 84*c* restricts the movement of the drum cartridge 9 in the second intersection direction Fp2. More specifically, the third guide surface 84*c* abuts the guided portion 27*b*, thereby restricting the movement of the drum cartridge 9.

The space between the first guide surface 84*a* and the second guide surface 84*b* can also be referred to as a "guide groove" of the guide member 84. In other words, the first guide surface 84*a* and the second guide surface 84*b* are portions forming the guide groove. The guided portion 27*b* is a portion to be engaged with the guide groove. In other words, the guided portion 27*b* can also be referred to as an "engagement portion" to be engaged with the guide member 84.

As illustrated in FIG. 8B, in a state where the drum cartridge 9 is attached to the apparatus main body 10, the first attachment portion 27*c* and a storage member 60 (described below) are located between the first guide surface 84*a* and the second guide surface 84*b*. In the present exemplary embodiment, the first attachment portion 27*c* and the storage member 60 are located between the first guide surface 84*a* and the second guide surface 84*b*, in the state where the guided portion 27*b* is guided by (engaged with) the guide member 27. In the present exemplary embodiment, the state where the guided portion 27*b* is guided by the guide member 27 includes the intermediate state of the attachment of the drum cartridge 9 to the apparatus main body 10.

In other words, the first attachment portion 27*c* and the storage member 60 are disposed in the guided portion 27*b*. As illustrated in FIG. 8B, the first attachment portion 27*c* and the storage member 60 overlap the guided portion 27*b* in the rotational axis direction of the photosensitive drum 1. The first attachment portion 27*c* and the storage member 60, however, do not come into contact with the guide member 84.

(Storage Member)

The storage member (e.g., first storage member) 60 is described with reference to FIGS. 9A, 9B, 10A, 10B, 11A, and 11B.

Figure 9A:
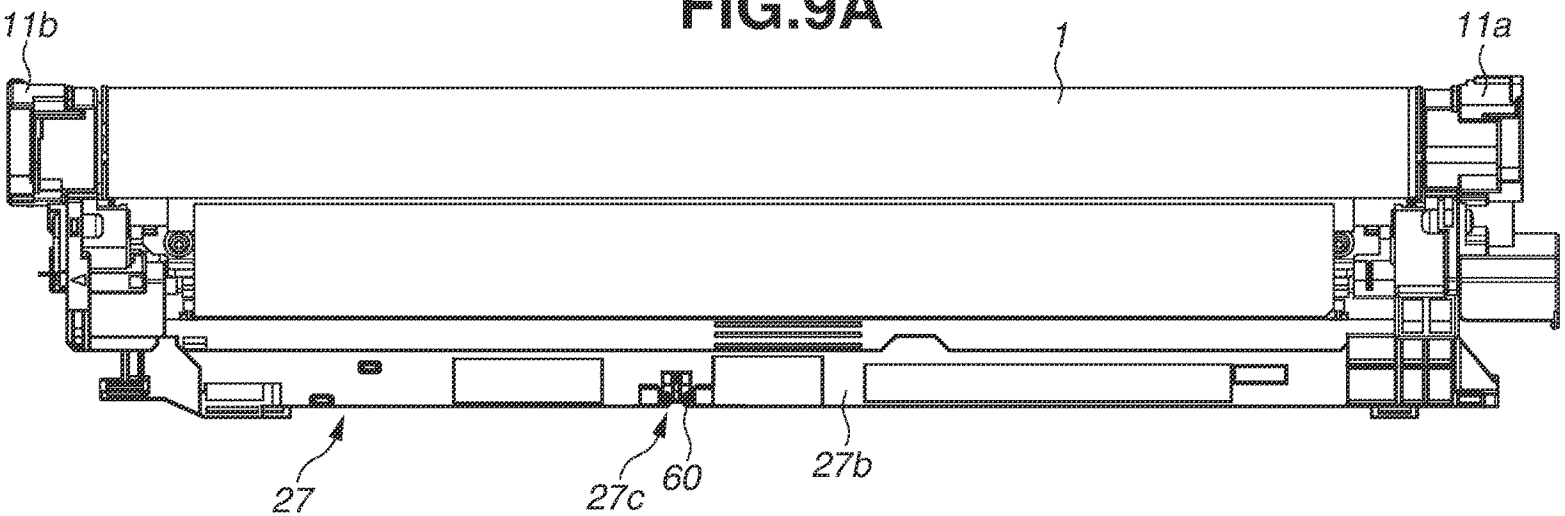
FIGS. 9A and 9B are diagrams illustrating placement of a storage member and a first attachment portion, according to one or more aspects of the subject disclosure.
Figure 9B:
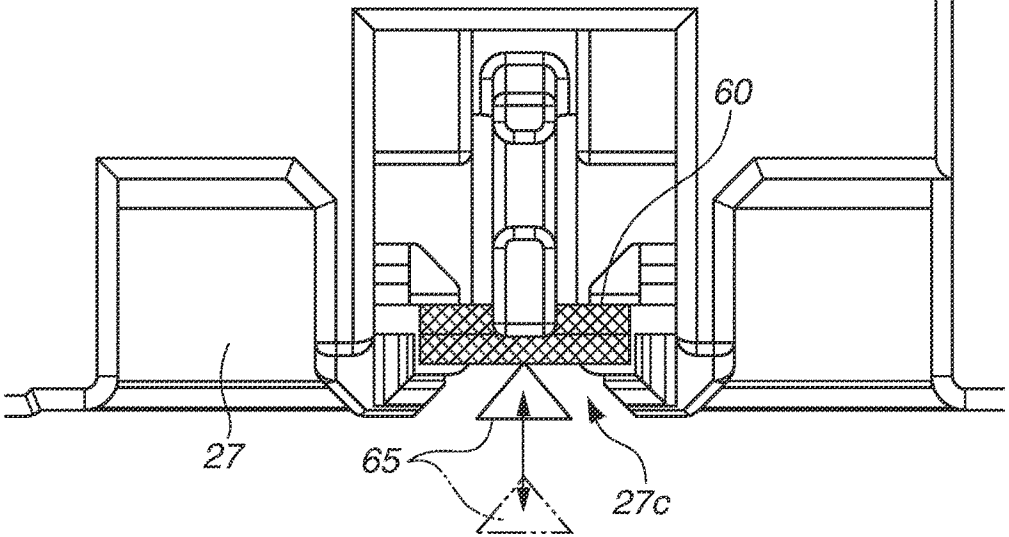
Figure 10A:
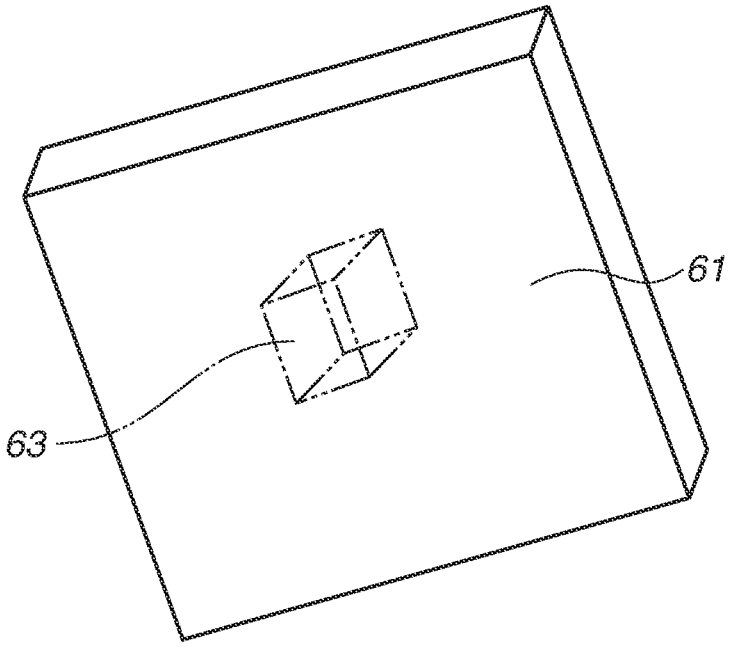
FIGS. 10A and 10B are diagrams illustrating the storage member, according to one or more aspects of the subject disclosure.
Figure 10B:
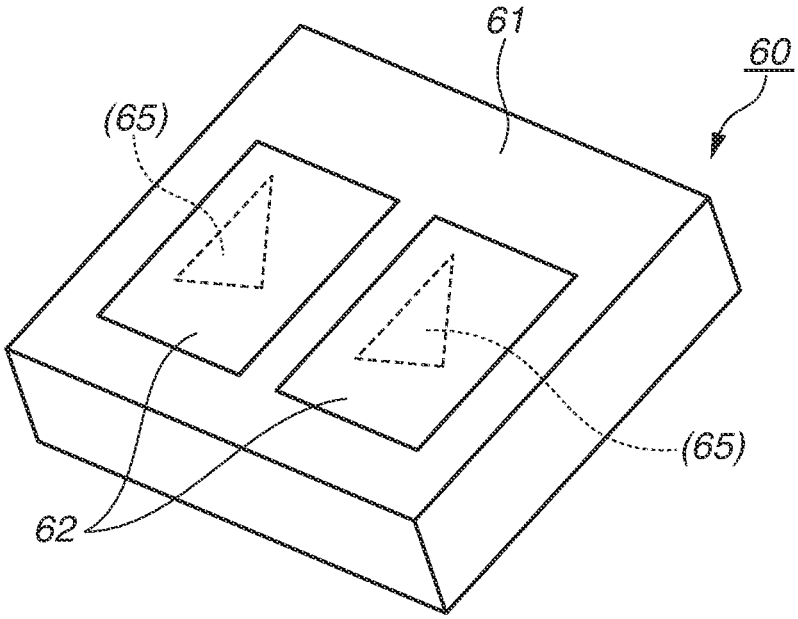
Figure 11A:
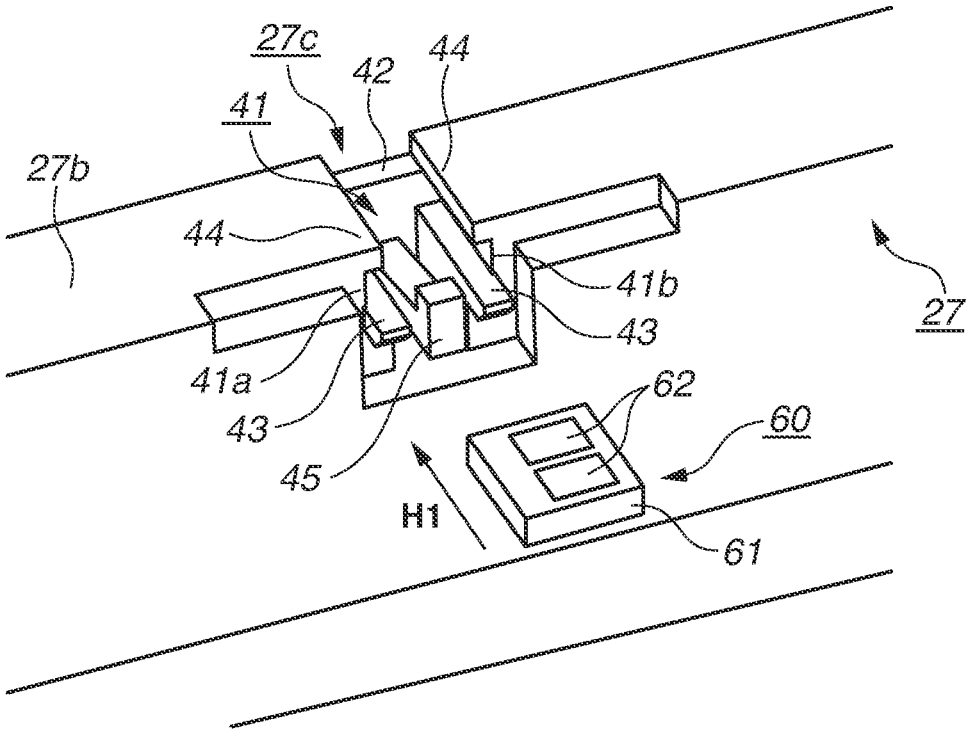
FIGS. 11A and 11B are diagrams illustrating attachment of the storage member, according to one or more aspects of the subject disclosure.
Figure 11B:
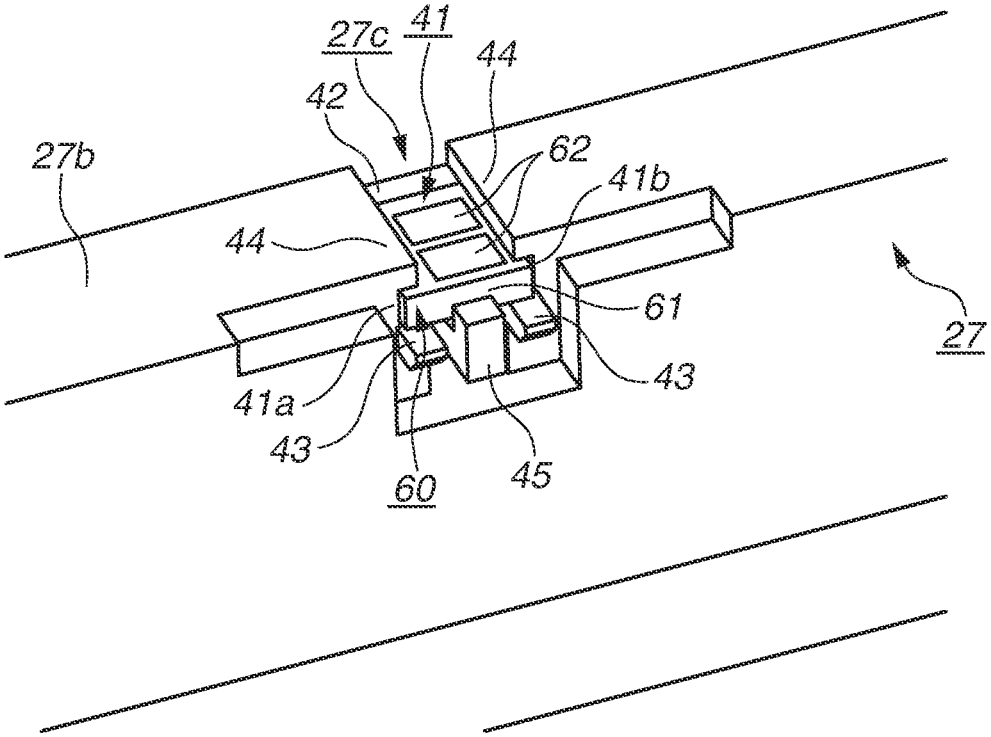

FIGS. 9A and 9B are diagrams illustrating the placement of the storage member 60 and the first attachment portion 27*c*. FIG. 9A is a diagram illustrating the entirety of the drum cartridge 9. FIG. 9B is an enlarged view of the first attachment portion 27*c*. A direction perpendicular to the plane of the paper in FIGS. 9A and 9B is the first intersection direction Fp1. FIGS. 10A and 10B are diagrams illustrating the storage member 60. FIG. 10A is a perspective view of the storage member 60. FIG. 10B is a perspective view of the storage member 60, and corresponds to the back side of the storage member 60 illustrated in FIG. 10A. FIGS. 11A and 11B are diagrams illustrating the attachment of the storage member 60. FIG. 11A is a diagram illustrating the state before the storage member 60 is attached. FIG. 11B is a diagram illustrating the state where the storage member 60 is attached.

As illustrated in FIG. 9A, the storage member 60 is attached to the drum cartridge 9. The drum frame member 27 includes the first attachment portion 27*c*. The first attachment portion 27*c* is provided in the guided portion 27*b*.

As illustrated in FIGS. 9A and 9B, the first attachment portion 27*c* is included on a lower surface of the drum frame member 27. The storage member 60 is attached to the first attachment portion 27*c*. Thus, the storage member 60 is also placed on the lower surface of the drum frame member 27. More specifically, in the state where the guided portion 27*b* is engaged with the guide member 27, first electrodes 62 are placed opposed to the third guide surface 84*c*.

As described above, the first attachment portion 27*c* and the storage member 60 are placed located between the first guide surface 84*a* and the second guide surface 84*b*, in the state where the drum cartridge 9 is attached to the apparatus main body 10. In the present exemplary embodiment, the first attachment portion 27*c* and the storage member 60 are placed so that the first attachment portion 27*c* and the storage member 60 are located between the first guide surface 84*a* and the second guide surface 84*b* in a state where the guided portion 27*b* is engaged with the guide member 27.

As illustrated in FIGS. 10A and 10B, the storage member 60 includes a first storage element 63 that stores information, the first electrodes 62, and a first substrate (e.g., first holding portion) 61 that holds the first storage element 63 and the first electrodes 62. The first electrodes 62 are electrically connected to the first storage element 63 within the first substrate 61.

As the first storage element 63, a so-called random-access memory (RAM) or read-only memory (ROM) is used. Examples of the information stored in the first storage element 63 include information regarding the drum cartridge 9 such as information regarding the life of the drum cartridge 9 (e.g., the accumulated rotation time of the photosensitive drum 1). The first storage element 63 may also store information regarding the apparatus main body 10, such as information regarding control of the apparatus main body 10 in the image forming operation.

The first electrodes 62 are placed on one surface side of the first substrate 61. The first storage element 63 is placed on the other surface side of the substrate 61 (the back side of the first electrodes 62 in the present exemplary embodiment).

The storage member 60 is attached to the drum frame member 27 by attaching the first substrate 61 to the first attachment portion 27*c*.

The apparatus main body 10 includes main body electrodes 65 that come into contact with the first electrodes 62. As illustrated in FIG. 9B, the first electrodes 62 are located at the positions where the first electrodes 62 can come into contact with the main body electrodes 65, in the state where the drum cartridge 9 is attached to the apparatus main body 10. As illustrated in FIG. 10B, a plurality of first electrodes 62 and a plurality of main body electrodes 65 are provided in the present exemplary embodiment.

In the present exemplary embodiment, the main body electrodes 65 and the first electrodes 62 abut each other, whereby the first storage element 63 and a control unit of the apparatus main body 10 communicate with each other. The control unit is electrically connected with the main body electrodes 65.

In the present exemplary embodiment, the main body electrodes 65 move in conjunction with the motion of a door (not illustrated) provided in the apparatus main body 10. When the door is closed, the opening portion 101 is covered by the door, and the main body electrodes 65 move in a direction toward the first electrodes 62 (e.g., upward in the vertical direction in the present exemplary embodiment) (refer to FIG. 9B). The main body electrodes 65 then come into contact with the first electrodes 62 and press the first electrodes 62. When the door is opened, the opening portion 101 is exposed, and the main body electrodes 65 move in a direction away from the first electrodes 62 (e.g., downward in the vertical direction in the present exemplary embodiment). The main body electrode 65 then move away from the first electrodes 62 (refer to FIG. 9B).

A description is given of an attachment method for attaching the storage member 60 to the drum cartridge 9. As illustrated in FIGS. 11A and 11B, the first attachment portion 27*c* includes a slit 41. The storage member 60 is inserted into the slit 41 of the first attachment portion 27*c* in the direction of an arrow H1 such that the first electrodes 62 are directed outward. In the present exemplary embodiment, the direction of the arrow H1 is the same as a direction intersecting the rotational axis of the photosensitive drum 1.

The first attachment portion 27*c* includes a restriction wall 42 on the far side of the slit 41. The first attachment portion 27*c* also includes reception ribs 43, retention portions 44, and a snap fit 45. These portions abut the first substrate 61, thereby restricting the position of the storage member 60.

The reception ribs 43 and the retention portions 44 restrict the movement of the first storage member in the thickness direction of the first substrate 61. The restriction wall 42, the snap fit 45, and side surface portions 41*a* and 41*b* of the slit 41 restrict the movement of the first storage member in directions intersecting the thickness direction of the first substrate 61. More specifically, the restriction wall 42 restricts the movement of the first storage member in the insertion direction of the first storage member. The snap fit 45 restricts the movement of the first storage member in a direction opposite to the insertion direction of the first storage member. The side surface portions 41*a* and 41*b* restrict the movement of the storage member 60 in the longitudinal direction of the drum cartridge 9 (e.g., the same as the rotational axis direction of the photosensitive drum 1).

The ends of the reception ribs 43 may be melted and then cooled, thereby forming melted portions that prevent the storage member 60 from coming out of the slit 41. The reception ribs 43 are melted by, for example, an ultrasonic welding method.

In the present exemplary embodiment, the first attachment portion 27*c* is molded integrally with the drum frame member 27. Alternatively, a configuration may be employed in which another member including the first attachment portion 27*c* is attached to the drum frame member 27.

(Remanufacturing Method for Remanufacturing Drum Cartridge)

A description is given of a disassembling method for disassembling the drum cartridge 9 and a remanufacturing method for remanufacturing the drum cartridge 9 with reference to FIGS. 1A, 1B, 12, 13, and 14.

Figure 1A:
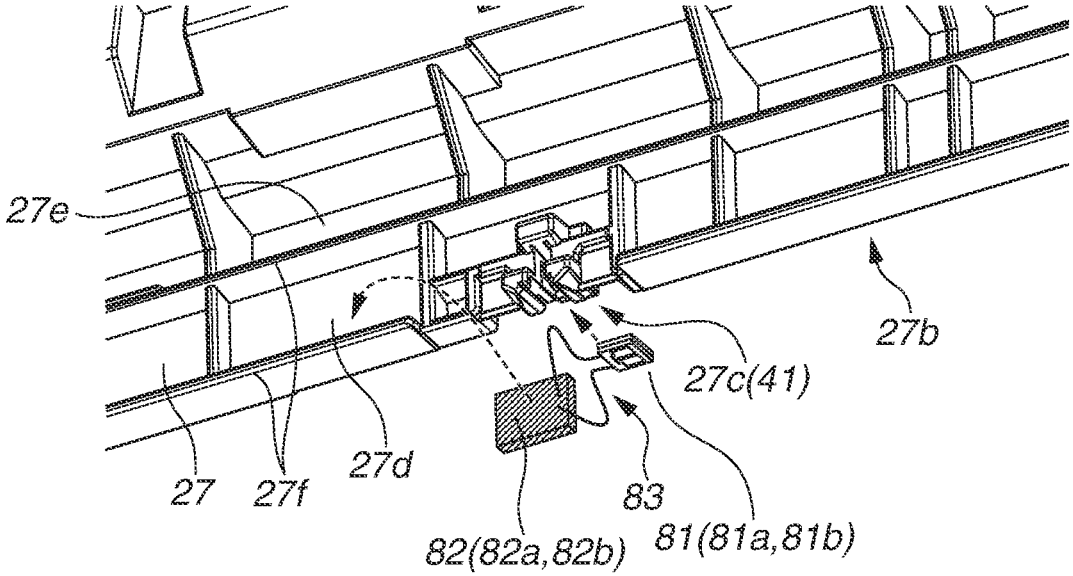
FIGS. 1A and 1B are diagrams illustrating an attachment step of attaching a storage unit, according to one or more aspects of the subject disclosure.
Figure 1B:
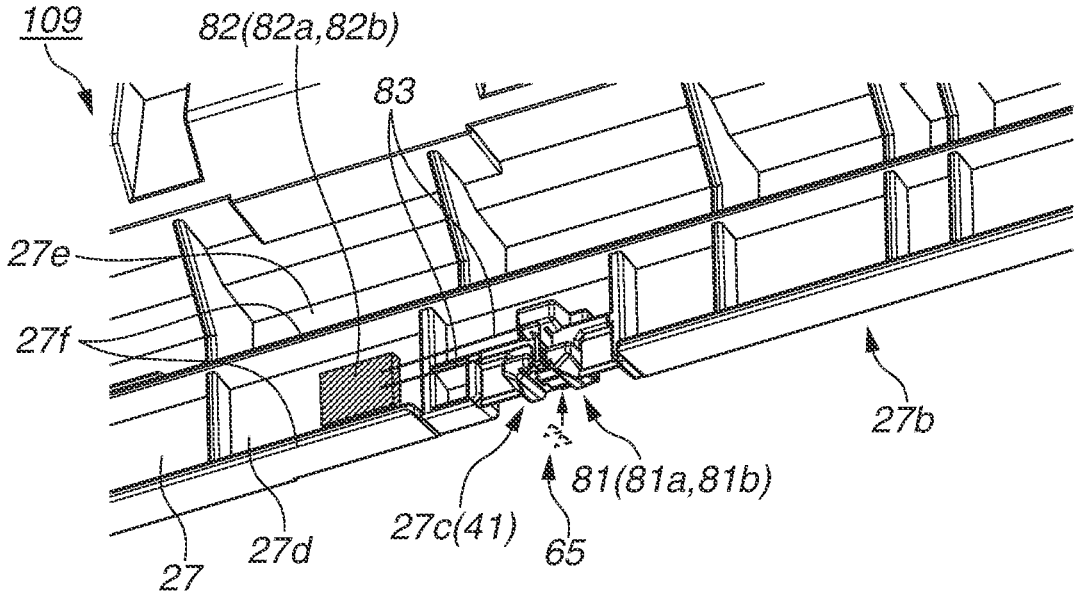
Figure 12:
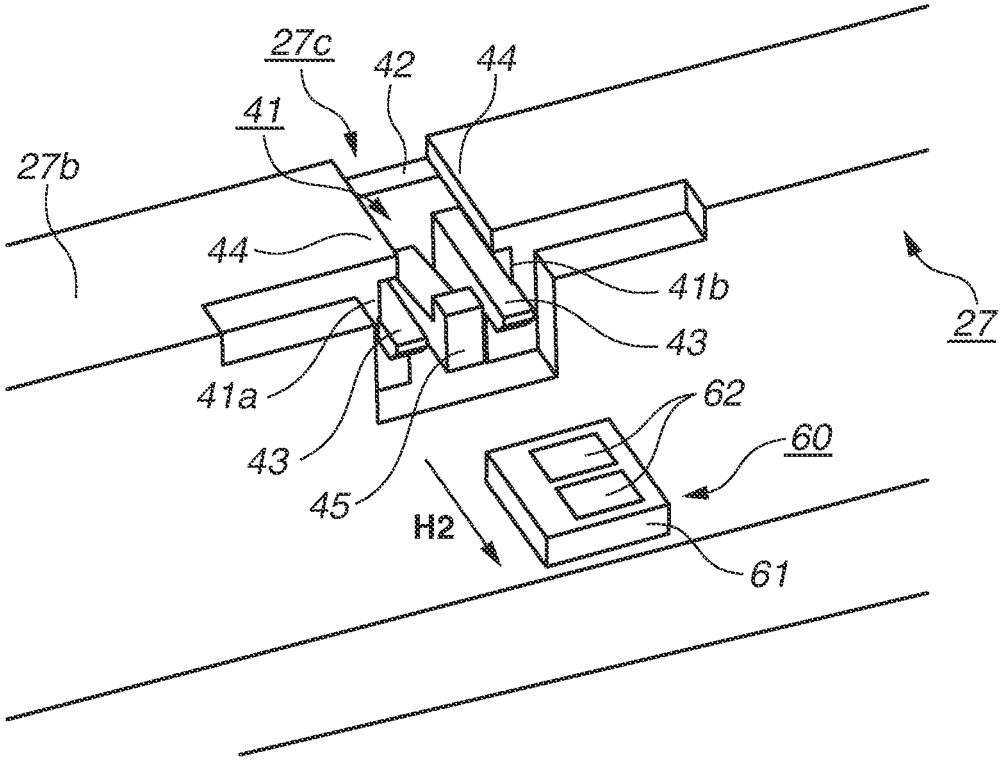
FIG. 12 is a diagram illustrating a detachment step of detaching the storage member, according to one or more aspects of the subject disclosure.
Figure 13:
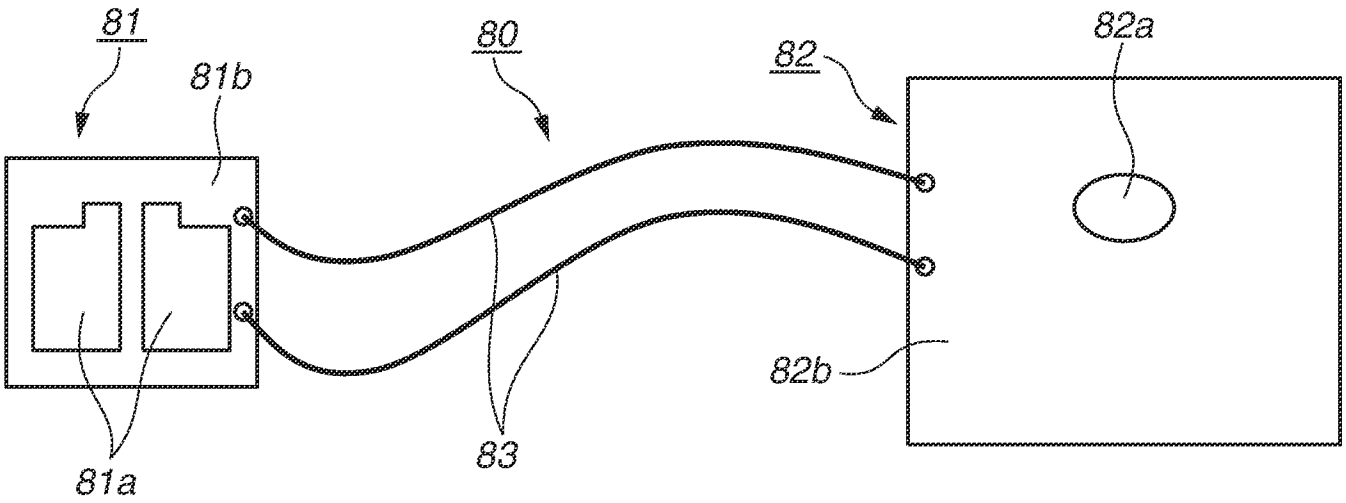
FIG. 13 is a diagram illustrating a storage unit, according to one or more aspects of the subject disclosure.
Figure 14:
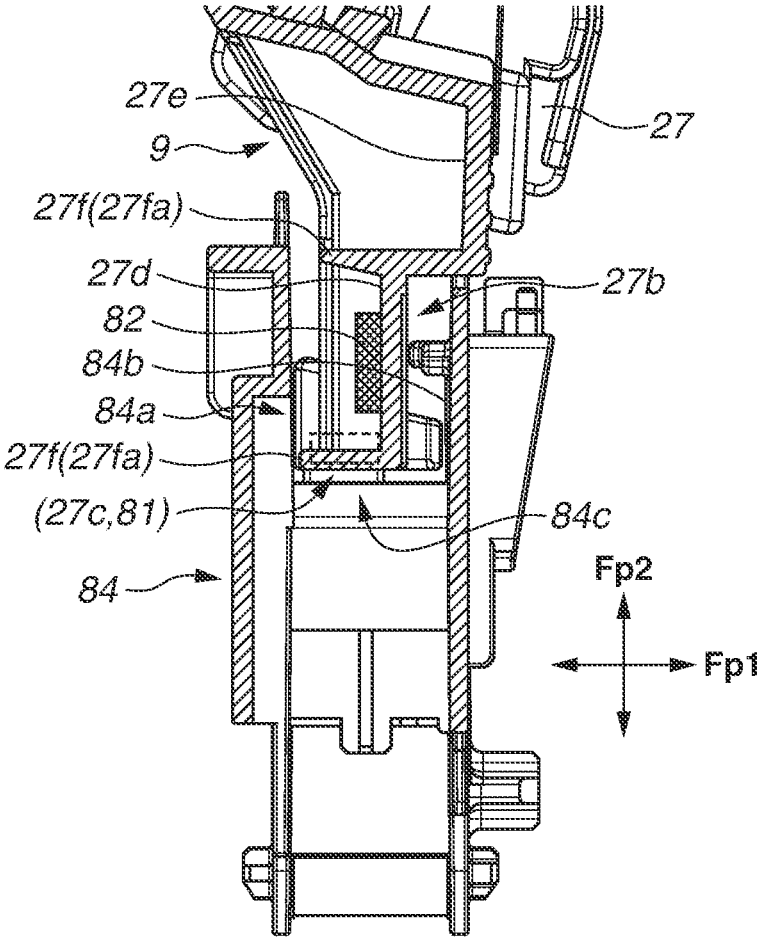
FIG. 14 is a cross-sectional view of the guide member and the drum cartridge, according to one or more aspects of the subject disclosure.

FIGS. 1A and 1B are diagrams illustrating an attachment step for attaching a storage unit 80. FIG. 1A is a diagram illustrating the state before the storage unit 80 is attached. FIG. 1B is a diagram illustrating the state where the storage unit 80 is attached. FIG. 12 is a diagram illustrating a detachment step for detaching the storage member 60. FIG. 13 is a diagram illustrating the storage unit 80. FIG. 14 is a cross-sectional view of the guide member 84 and the drum cartridge 9.

For example, in a case where the storage member 60 of the collected drum cartridge 9 is damaged, and when the drum cartridge 9 is remanufactured, the storage member 60 may be replaced with a new storage member (e.g., a member including a new storage element and new electrodes). Meanwhile, as described above, the first attachment portion 27*c* and the storage member 60 are placed located between the first guide surface 84*a* and the second guide surface 84*b*, in the state where the drum cartridge 9 is attached to the apparatus main body 10. In other words, the first attachment portion 27*c* and the storage member 60 are placed in the guided portion 27*b*. Thus, the storage member 60 has such a shape and a size that the storage member 60 does not collide with the guide member 84 when the drum cartridge 9 is attached or detached.

In a case where the new storage member is attached similarly to the storage member 60, shape and size requirements for the new storage member to prevent collision with the guide member 84 are the same as requirements for the storage member 60. In the present exemplary embodiment, the new storage element is attached to a different position from those of the new electrodes, while the new electrodes are placed at the positions where the first electrodes 62 have been placed. This can ease the shape and size requirements for the new storage member more than the requirements for the storage member 60.

The disassembling method for disassembling the drum cartridge 9 according to the present exemplary embodiment includes a detachment step for detaching the storage member 60. The remanufacturing method for remanufacturing the drum cartridge 9 according to the present exemplary embodiment includes the detachment step for detaching the storage member 60 and an attachment step for attaching the new storage unit 80 different from the storage member 60. In other words, the remanufacturing method for remanufacturing the drum cartridge 9 can also be referred to as a "replacement method for replacing the storage member 60 with the storage unit 80".

A description is given below of the detachment step for detaching the storage member 60 and the attachment step for attaching the new storage unit 80.

<Detachment Step for Detaching Storage Member>

A used drum cartridge (first cartridge or material cartridge) 9 is prepared.

As illustrated in FIG. 12, the first substrate 61 is detached from the first attachment portion 27*c* by pressing the storage member 60 in a direction opposite to the insertion direction. At this time, the snap fit 45 is moved to allow the detachment of the first substrate 61. This can detach the storage member 60 from the first attachment portion 27*c*. The storage member 60 may be detached from the first attachment portion 27*c* by removing the snap fit 45.

In a case where the melted portions are formed at the ends of the reception ribs 43, the storage member 60 can be detached from the first attachment portion 27*c* by removing the melted portions. The melted portions may be destroyed by pressing the melted portions with the first substrate 61.

<Configuration of Information Storage Unit>

A description is given of the storage unit 80, which is attached to the drum frame member 27 by replacing the storage member 60.

As illustrated in FIG. 13, the storage unit 80 includes an electrode unit 81 and an element unit 82. The electrode unit 81 includes second electrodes (e.g., cartridge electrodes or new electrodes) 81*a* and a second substrate (e.g., electrode holding portion or second holding portion) 81*b* that holds the second electrodes 81*a*. The element unit 82 includes a second storage element (e.g., storage element or new storage element) 82*a* that stores information, and a third substrate (e.g., element holding portion or third holding portion) 82*b* that holds the second storage element 82*a*. In the present exemplary embodiment, the third substrate 82*b* is larger than the slit 41. That is, the third substrate 82*b* cannot be inserted into the slit 41.

In the present exemplary embodiment, the second storage element 82*a* and the second electrodes 81*a* are electrically connected together by conduction path members (connection members) 83. The conduction path members 83 may be attached to the second storage element 82*a* and the second electrodes 81*a* in the process of remanufacturing the drum cartridge 9. The conduction path members 83 connected to one of the second storage element 82*a* and the second electrodes 81*a* may be attached to the other of the second storage element 82*a* and the second electrodes 81*a* in the process of remanufacturing the drum cartridge 9. In these cases, it can be said that the remanufacturing method for remanufacturing the drum cartridge 9 includes a connection step of electrically connecting the second storage element 82*a* and the second electrodes 81*a* by the conduction path members 83. For example, the second storage element 82*a* and the second electrodes 81*a* may be electrically connected by the conduction path members 83 by performing the connection step, after at least one of the second storage element 82*a* and the second electrodes 81*a* is attached to the drum frame member 27. The conduction path members 83 may be connected to the second storage element 82*a* and the second electrodes 81*a* in advance. In other words, the second storage element 82*a* and the second electrodes 81*a* may be attached to the drum frame member 27, in the state where the second storage element 82*a* and the second electrodes 81*a* are electrically connected together by the conduction path members 83. In any case, the second storage element 82*a* and the second electrodes 81*a* are electrically connected together by the conduction path members 83, in the state where the remanufacturing of the drum cartridge 9 is completed.

In the present exemplary embodiment, the conduction path members 83 are fixed to the second electrodes 81*a* by soldering. Similarly, the conduction path members 83 are fixed to the second storage element 82*a* by soldering. The conduction path members 83 have flexibility and can be freely deformed. Consequently, the conduction path members 83 can easily connect the electrode unit 81 and the element unit 82 even if the electrode unit 81 and the element unit 82 are placed at positions away from each other.

The functions of the second electrodes 81*a* and the relationships between the second electrodes 81*a* and the main body electrodes 65 are similar to the functions of the first electrodes 62 and the relationships between the first electrodes 62 and the main body electrodes 65, and therefore are not described in detail. In the present exemplary embodiment, shapes and a number of second electrodes 81*a* are the same as shapes and a number of first electrodes 62.

As the second storage element 82*a*, a so-called RAM or ROM is used. The second storage element 82*a* stores information similar to that stored in the first storage element 63.

The total of the sizes of the second substrate 81*b* and the third substrate 82*b* is larger than the size of the slit 41. More specifically, at least either one of the total of the sizes of the second substrate 81*b* and the third substrate 82*b* in the thickness directions and the total of the sizes of the second substrate 81*b* and the third substrate 82*b* in directions intersecting the thickness directions is larger than the corresponding size of the slit 41. In other words, the second substrate 81*b* and the third substrate 82*b* cannot be simultaneously inserted into the slit 41.

In the present exemplary embodiment, the size of the third substrate 82*b* in the direction intersecting the thickness direction is larger than the size of the slit 41 in the corresponding direction (e.g., the size of the space defined by the side surface portions 41*a* and 41*b*, the restriction wall 42, and the snap fit 45).

The size of the third substrate 82*b* in the thickness direction may be larger than the size of the slit 41 in the corresponding direction (e.g., the size of the gap between the reception ribs 43 and the retention portions 44).

Even in a case where such an electrode unit 81 and an element unit 82 are used, the electrode unit 81 and the element unit 82 can be attached to the drum frame member 27 by a method described below.

Next, a description is given of an attachment step for attaching the electrode unit 81 to the drum cartridge 9 and an attachment step for attaching the element unit 82 to the drum cartridge 9.

<Attachment Step for Attaching Electrode Unit>

The second electrodes 81*a* are attached to the drum frame member 27 (an electrode attachment step). The second electrodes 81*a* are placed at the positions where the second electrodes 81*a* can come into contact with the main body electrodes 65 when the drum cartridge 9 is attached to the apparatus main body 10.

In other words, the second electrodes 81*a* are placed at the positions where the first electrodes 62 have been placed. The second electrodes 81*a* are located between the first guide surface 84*a* and the second guide surface 84*b* in the state where the drum cartridge 9 is attached to the apparatus main body 10. In the present exemplary embodiment, the second electrodes 81*a* are located between the first guide surface 84*a* and the second guide surface 84*b*, in the state where the guided portion 27*b* is engaged with the guide member 27. The second electrodes 81*a* are placed opposed to the third guide surface 84*c*, in the state where the guided portion 27*b* is engaged with the guide member 27. In other words, the second electrodes 81*a* are placed in the guided portion 27*b*. In the present exemplary embodiment, the second substrate 81*b* is also placed in the guided portion 27*b*. The second electrodes 81*a* and the second substrate 81*b* do not come into contact with the guide member 84.

As illustrated in FIGS. 1A and 1B, the second electrodes 81*a* are attached to the drum frame member 27 through the second substrate 81*b* in the present exemplary embodiment. More specifically, the second substrate 81*b* is inserted into the slit 41 of the first attachment portion 27*c*, whereby the second electrodes 81*a* are attached to the drum frame member 27. The second substrate 81*b* may be bonded to the drum frame member 27 with, for example, an adhesive.

The second electrodes 81*a* may be bonded to the drum frame member 27 with an adhesive or a tape. In this case, the adhesive or the tape corresponds to the second holding portion.

After the first storage element 63 is removed, the storage member 60 may be used as the electrode unit 81. In this case, the first substrate 61 functions as the second substrate 81*b*, and the first electrodes 62 function as the second electrodes 81*a*. By this method, the electrode unit 81 can be attached to the drum frame member 27 with accuracy equivalent to that of the storage member 60.

<Attachment Step for Attaching Element Unit>

The second storage element 82*a* is attached to the drum frame member 27 (an element attachment step). In the present exemplary embodiment, the second storage element 82*a* is attached to the drum frame member 27 through the third substrate 82*b*. The third substrate 82*b* is attached using, for example, an adhesive.

A description is given of the position where the second storage element 82*a* is attached. As illustrated in FIG. 7, the guided portion 27*b* provided in a lower portion of the drum frame member 27 is guided by the guide member 84 provided in the image forming apparatus main body 10 when the drum cartridge 9 is attached or detached. The second storage element 82*a* is placed at the position where the second storage element 82*a* does not abut the guide member 84 when the drum cartridge 9 is attached or detached.

As illustrated in FIGS. 1A and 14, the second storage element 82*a* and the third substrate 82*b* can be attached to a first recessed portion 27*d* or a second recessed portion 27*e* of the drum frame member 27. Each of the first recessed portion 27*d* and the second recessed portion 27*e* is a second attachment portion to which the second storage element 82*a* is attached. The first recessed portion 27*d* and the second recessed portion 27*e* are located at different positions from that of the first attachment portion 27*c*.

In the present exemplary embodiment, the first recessed portion 27*d* and the second recessed portion 27*e* are located at positions away from the first attachment portion 27*c*. In the present exemplary embodiment, the positions of the first recessed portion 27*d* and the second recessed portion 27*e* are away from the position of the first attachment portion 27*c*, in the rotational axis direction of the photosensitive drum 1 (e.g., the longitudinal direction of the drum cartridge 9). In other words, the positions of the first recessed portion 27*d* and the second recessed portion 27*e* and the position of the first attachment portion 27*c* do not overlap each other. Thus, the second substrate 81*b* and the third substrate 82*b* are located at positions away from each other.

In the present exemplary embodiment, the first recessed portion 27*d* and the second recessed portion 27*e* are located at positions skewed to the first attachment portion 27*c*. That is, the extension direction of the third substrate 82*b* and the extension direction of the first substrate 61 intersect (in the present exemplary embodiment, are orthogonal to) each other. The extension direction of the third substrate 82*b* and the extension direction of the second substrate 81*b* intersect (in the present exemplary embodiment, are orthogonal to) each other. In other words, the extension direction of the surface to which the second substrate 81*b* is attached and the extension direction of the surface to which the third substrate 82*b* is attached intersect (in the present exemplary embodiment, are orthogonal to) each other.

As illustrated in FIG. 14, the second recessed portion 27*e* is at the position where the second recessed portion 27*e* is not engaged with the guide member 84, in the state where the guided portion 27*b* is guided by the guide member 84. That is, the second recessed portion 27*e* is located at a position away from the first guide surface 84*a* in the second intersection direction Fp2. In other words, the position of the second recessed portion 27*e* does not overlap the position of the first guide surface 84*a* in the second intersection direction Fp2. This can prevent the second storage element 82*a* from abutting the guide member 84 when the drum cartridge 9 is attached or detached.

The first recessed portion 27*d* is at a position opposed to the guide member 84, in the state where the guided portion 27*b* is engaged with (guided by) the guide member 84.

As illustrated in FIGS. 1A, 1B, and 14, the drum frame member 27 includes a protruding portion 27*f* around the first recessed portion 27*d*. The protruding portion 27*f* protrudes relative to the first recessed portion 27*d* in the first intersection direction Fp1. As illustrated in FIG. 14, in the present exemplary embodiment, an end 27*fa* of the protruding portion 27*f* is opposed to the first guide surface 84*a* in the state where the guided portion 27*b* is guided by the guide member 84. In the present exemplary embodiment, the end 27*fa* of the protruding portion 27*f* is guided by the first guide surface 84*a*. In other words, it can also be said that the end 27*fa* is a part of the guided portion 27*b*.

As illustrated in FIG. 14, the end 27*fa* of the protruding portion 27*f* is located at a position closer to the first guide surface 84*a* than the element unit 82 (e.g., the second storage element 82*a* and the third substrate 82*b*) is, in the first intersection direction Fp1. With this configuration, it is possible to avoid contact between the element unit 82 and a lower rail (the guide member 84) when the drum cartridge 9 is attached to or detached from the apparatus main body 10, and thus prevent the element unit 82 from being damaged. Accordingly, it is possible to enhance the reliability of a remanufactured cartridge.

In the present exemplary embodiment, the second storage element 82*a* and the third substrate 82*b* are attached to the first recessed portion 27*d*. As described above, the second storage element 82*a* and the third substrate 82*b* may be attached to the second recessed portion 27*e*.

The attachment position of the storage unit 80 is not limited to the position described in the present exemplary embodiment. That is, the storage unit 80 can be freely placed at any position as long as the storage unit 80 does not abut the guide member 84. For example, the storage unit 80 may be placed on the back side of the first recessed portion 27*d*.

Figure 15A:
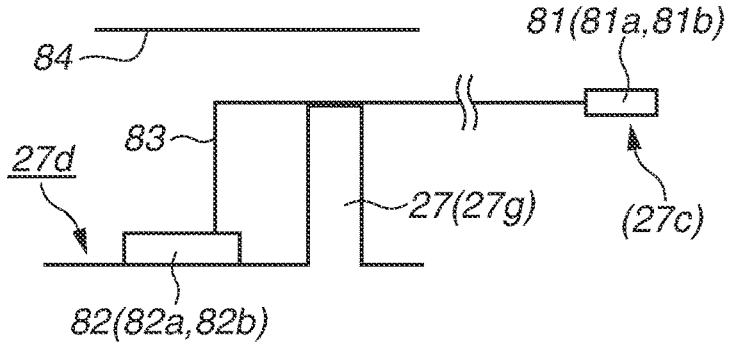
FIGS. 15A, 15B, 15C, and 15D are diagrams illustrating placement of a conduction path member, according to one or more aspects of the subject disclosure.
Figure 15B:
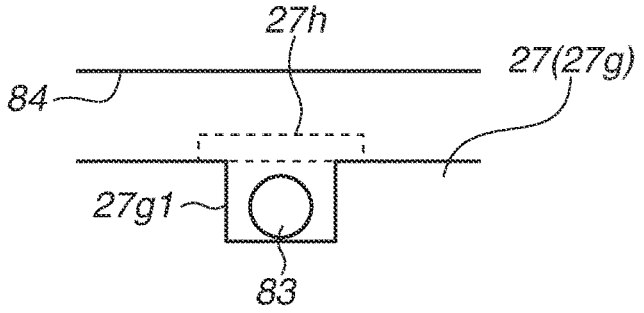
Figure 15C:
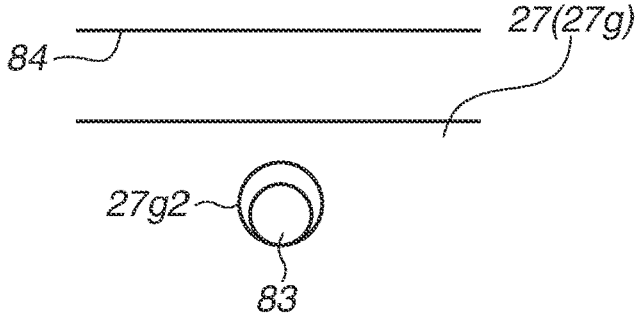
Figure 15D:
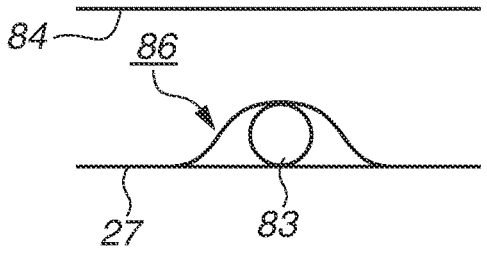

The placement of each conduction path member 83 is described with reference to FIGS. 15A, 15B, 15C, and 15D. FIGS. 15A, 15B, 15C, and 15D are diagrams illustrating the placement of the conduction path member 83. FIG. 15A is a diagram illustrating the vicinity of the second storage element 82*a* when viewed in the second intersection direction Fp2. FIGS. 15B to 15D are cross-sectional views orthogonal to the extension direction of the conduction path member 83.

To prevent the conduction path member 83 from being damaged, it is desirable to place the conduction path member 83 so as not to come into direct contact with the guide member 84. To prevent the conduction path member 83 from coming into contact with the guide member 84, it is desirable to place the conduction path member 83 to come into contact with the drum frame member 27. For example, the drum frame member 27 may include a wall 27*g* that protrudes toward the guide member 84, and the wall 27*g* may be placed between the second storage element 82*a* and the second electrode 81*a* or near the second storage element 82*a*. In this case, the conduction path member 83 may be brought into contact with the end of the wall 27*g* (refer to FIG. 15A).

The conduction path member 83 may be brought into contact with a second attachment portion (e.g., a bottom portion of the first recessed portion 27*d*, and a bottom portion of the second recessed portion 27*e*).

A passage through which the conduction path member 83 passes may be formed by removing a part of the drum frame member 27 (a passage formation step). For example, a notch

27*g*1 may be formed at the end of a wall 27*g*, and the conduction path member 83 may be passed through the notch 27*g*1 (refer to FIG. 15B). At this time, it is desirable that the depth of the notch 27*g*1 should be great enough to prevent the conduction path member 83 from protruding from the end of the wall 27*g*. A cover member 27*h* that covers the notch 27*g*1 may be attached to the drum frame member 27, thereby preventing the conduction path member 83 from coming out of the notch 27*g*1. A hole 27*g*2 may be formed in a wall 27*g*, and the conduction path member 83 may be passed through the hole 27*g*2 (refer to FIG. 15C). It is desirable to place the conduction path member 83 to come into contact with the surface on which the notch 27*g*1 or the hole 27*g*2 is formed.

A cover member 86 may cover at least a part of the conduction path member 83 between the second storage element 82*a* and the second electrode 81*a* (refer to FIG. 15D), to prevent the conduction path member 83 from coming into contact with the guide member 84. At least a part of the cover member 86 is located between the conduction path member 83 and the guide member 84. The cover member 86 prevents the conduction path member 83 from deforming toward the guide member 84. Further, the cover member 86 facilitates the maintenance of the state where the conduction path member 83 is in contact with the drum frame member 27. As the cover member 86, a sheet member, a tape, or a substance that is cured at normal temperature (e.g., an epoxy resin, and an adhesive) can be used. As described above, the storage member 60 can be replaced with the storage unit 80. The drum cartridge 9 can be remanufactured. That is, a new drum cartridge (second cartridge or cartridge) 109 can be manufactured from the used drum cartridge (first cartridge or material cartridge) 9 (refer to FIG. 1B). The new drum cartridge 109 has a configuration similar to that of the drum cartridge 9, except that the storage member 60 is replaced with the storage unit 80. The new drum cartridge 109 is attachable to and detachable from the apparatus main body 10. In other words, the new drum cartridge 109 is the drum cartridge 9 in which the storage member 60 is replaced with the storage unit 80.

During the process of remanufacturing the drum cartridge 9, a component such as the photosensitive drum 1, the cleaning member 6, or the charging roller 2 may be replaced, or the residual toner chamber 27*a* may be cleaned. That is, the new drum cartridge 109 may further include at least one of another photosensitive drum, another cleaning member, and another charging roller 2.

In the present exemplary embodiment, the second storage element 82*a* is attached to a different position from those of the second electrodes 81*a*, while the second electrodes 81*a* are placed at the positions where the first electrodes 62 have been placed. This eliminates the need to secure the space where both the second electrodes 81*a* and the second storage element 82*a* are placed at the position where the storage member 60 has been attached. That is, it is not necessary to secure the space where the second storage element 82*a* is placed, so long as the space where the second electrodes 81*a* are placed can be secured. In other words, the second storage element 82*a* does not need to have such a shape and a size that the second storage element 82*a* can be attached to the first attachment portion 27*c* together with the second electrodes 81*a*, so long as the second electrodes 81*a* can be placed similarly to the first electrodes 62.

That is, it is possible to ease size and shape requirements for the second storage element 82*a* as compared with a case where a storage member that holds both new electrodes and a new storage element is attached to the first attachment portion 27*c* similarly to the storage member 60. Similarly, it is possible to ease size and shape requirements for the third substrate 82*b* that holds the second storage element 82*a*. For example, the element unit 82 can be attached to the drum frame member 27 even if the third substrate 82*b* is larger than the slit 41.

Thus, it is possible to ease shape and size requirements for a new storage member (e.g., a member including the second electrodes 81*a* and the second storage element 82*a*), in a case where the drum cartridge 9 is remanufactured.

In the above description, the method for replacing a storage member of the drum cartridge 9 has been described. The present disclosure, however, is not limited to this. The present disclosure can also be applied to, for example, the developing cartridge 4, a toner cartridge that stores toner, or another cartridge (e.g., a replacement component configured to be attachable to and detachable from the apparatus main body 10).

As described above, according to the present disclosure, it is possible to ease shape and size requirements for a new storage member (a member including a new storage element and new electrodes), in a case where a cartridge is remanufactured by replacing a storage member placed in a portion to be engaged with a guide member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A cartridge attachable to and detachable from an apparatus main body of an image forming apparatus, the apparatus main body including a main body electrode and a guide member configured to guide the cartridge when the cartridge is attached or detached, the cartridge comprising:

a frame member including an engagement portion configured to be engaged with the guide member;

a cartridge electrode configured to come into contact with the main body electrode;

an electrode holding portion configured to hold the cartridge electrode and be attached to the frame member;

a storage element configured to store information;

an element holding portion configured to hold the storage element and be attached to the frame member; and a connection member configured to electrically connect the cartridge electrode and the storage element, wherein the cartridge electrode and the electrode holding portion are placed in the engagement portion, and the element holding portion is attached to the frame member at a position away from the electrode holding portion.

2. The cartridge according to claim 1, wherein the guide member includes a first guide surface and a second guide surface opposed to the first guide surface, and the first and second guide surfaces are configured to restrict a movement of the cartridge in a first intersection direction intersecting an attachment direction of the cartridge, and wherein in a case where the engagement portion is engaged with the guide member, the cartridge electrode is located between the first and second guide surfaces.

3. The cartridge according to claim 2, wherein the guide member includes a third guide surface configured to restrict a movement of the cartridge in a second intersection direction intersecting the attachment direction and the first intersection direction, and wherein in a case where the engagement portion is engaged with the guide member, the cartridge electrode is placed opposed to the third guide.

4. The cartridge according to claim 3, wherein in the second intersection direction, the element holding portion is located at a position away from the first guide surface.

5. The cartridge according to claim 3, wherein in a case where the engagement portion is engaged with the guide member, the element holding portion is placed at a position opposed to the first guide surface.

6. The cartridge according to claim 2, wherein the frame member includes a protruding portion, and the protruding portion is placed so that in a case where the engagement portion is engaged with the guide member, an end of the protruding portion is opposed to the first guide surface, and wherein the end is located at a position closer to the first guide surface than the storage element.

7. The cartridge according to claim 1, wherein the frame member includes a slit into which the electrode holding portion is inserted, and wherein the element holding portion is larger than the slit.

8. The cartridge according to claim 1, wherein the connection member has flexibility.

9. The cartridge according to claim 1, further comprising an image bearing member configured to bear an electrostatic latent image and rotatably supported by the frame member.

* * * * *